US006118958A

United States Patent [19]

Nagashima

[11] Patent Number: 6,118,958

[45] **Date of Patent: *Sep. 12, 2000**

[54] SEALING MEMBER, SEALING MEMBER MOUNTING METHOD, DEVELOPING APPARATUS, PROCESS CARTRIDGE, PROCESS CARTRIDGE REMANUFACTURING METHOD AND IMAGE FORMING APPARATUS

[75] Inventor: Toshiaki Nagashima, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,565

[22] Filed: May 19, 1997

Related U.S. Application Data

[63] Continuation of application No. 08/274,399, Jul. 13, 1994, abandoned.

[30] Foreign Application Priority Data

Jul. 14, 1993 [JP] Japan ..... 5-174117
Oct. 26, 1993 [JP] Japan ..... 5-267366

[51] Int. Cl.[7] ..... G03G 15/08

[52] U.S. Cl. ..... 399/105; 399/103

[58] Field of Search ..... 399/98, 102, 103, 399/105, 106, 110, 119; 222/DIG. 1

[56] References Cited

U.S. PATENT DOCUMENTS

| | | | |
|---|---|---|---|
| 4,816,877 | 3/1989 | Keen . | |
| 4,862,210 | 8/1989 | Woolley | 355/245 |
| 4,930,684 | 6/1990 | Patterson | 222/325 |
| 4,931,838 | 6/1990 | Ban et al. . | |
| 4,981,218 | 1/1991 | Ban et al. | 222/DIG. 1 X |
| 5,080,745 | 1/1992 | Paull | 156/247 |
| 5,110,646 | 5/1992 | Prestel et al. | 428/43 |
| 5,111,976 | 5/1992 | Ban | 222/485 |
| 5,177,540 | 1/1993 | Honda et al. . | |
| 5,184,182 | 2/1993 | Michlin . | |
| 5,223,068 | 6/1993 | Baley | 156/250 |
| 5,258,814 | 11/1993 | Davies . | |
| 5,266,998 | 11/1993 | Lee . | |
| 5,267,003 | 11/1993 | Grappiolo | 355/260 |
| 5,294,960 | 3/1994 | Nomura et al. . | |
| 5,296,902 | 3/1994 | Michlin | 355/260 |
| 5,335,831 | 8/1994 | Foster | 222/DIG. 1 X |
| 5,370,761 | 12/1994 | Chitouras | 222/DIG. 1 X |
| 5,407,518 | 4/1995 | Baley, Jr. | 156/344 |

FOREIGN PATENT DOCUMENTS

| | | |
|---|---|---|
| 0131697 | 1/1985 | European Pat. Off. . |
| 0330225 | 8/1989 | European Pat. Off. . |
| 0485271A2 | 5/1992 | European Pat. Off. . |
| 0485271A3 | 5/1992 | European Pat. Off. . |
| 0622705 | 11/1994 | European Pat. Off. . |
| 4086772 | 3/1992 | Japan . |
| WO 9210404 | 6/1992 | WIPO . |

OTHER PUBLICATIONS

Lasher, et al., Lid Assembly, IBM Technical Disclosure Bulletin, vol. 13, No. 11, April, 1971, p. 3218.

*Primary Examiner*—Sandra Brase
*Attorney, Agent, or Firm*—Fitzpatrick, Cella, Harper & Scinto

[57] ABSTRACT

A developing apparatus usable with an image forming apparatus includes a frame having developing device; a toner accommodation container having an opening for supplying toner to the developing device and for accommodating the toner; and an elastic sheet inserted between the frame and the toner accommodation container to seal the opening, wherein the elastic sheet has a thickness larger than the gap when it is not compressed, and has a flexible sheet projected out of the gap. A method of sealing an opening of the toner accommodation container, includes detachably mounting an elastic sheet to a longitudinal end of an insertion member; then inserting the insertion member between the toner accommodation container and the frame to a position for sealing the opening by the elastic sheet; and then removing the elastic sheet from the insertion member. A sealing member for sealing an opening of a toner accommodating container includes a flexible film; and an elastic sheet on the flexible film.

46 Claims, 16 Drawing Sheets

SEALING MEMBER, SEALING MEMBER MOUNTING METHOD, DEVELOPING APPARATUS, PROCESS CARTRIDGE, PROCESS CARTRIDGE REMANUFACTURING METHOD AND IMAGE FORMING APPARATUS

This application is a continuation of application Ser. No. 08/274,399, filed Jul. 13, 1994, now abandoned.

FIELD OF THE INVENTION AND RELATED ART

The present invention relates to a sealing member, a sealing member mounting method, a developing apparatus, a process cartridge, a process cartridge remanufacturing method and an image forming apparatus.

Electrophotographic type image forming machines are widely used as in copying machines or the like. In such an apparatus, a surface of an electrophotographic photosensitive drum which is rotated is uniformly charged, and a selective image exposure thereof is effected to form a latent image thereon. The latent image is visualized with toner and the toner image is transferred onto a recording material. In some of such apparatuses, a photosensitive drum and a developing device having a developer container or the like are unified into a cartridge, which is detachably mountable to an image forming apparatus. The latent image formed on the photosensitive drum is developed with developer contained in the developer container in the cartridge.

In order to prevent leakage of developer from the developer container during transportation of the process cartridge, an opening of the developer container is sealed by a sealing member. Prior to the start of use, the user removes the sealing member to open the developer opening of the container, by which the developer in the container is permitted to be supplied to the developing roller or the like through the opening of the container.

The present invention provides a further improvement in such an apparatus.

SUMMARY OF THE INVENTION

Accordingly, it is a principal object of the present invention to provide a sealing member, a sealing member mounting method, a developing apparatus, a process cartridge, a process cartridge remanufacturing method and an image forming apparatus in which the sealing member is easily mountable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the first embodiment of the present invention will be described.

EMBODIMENT 1

Figure 1:
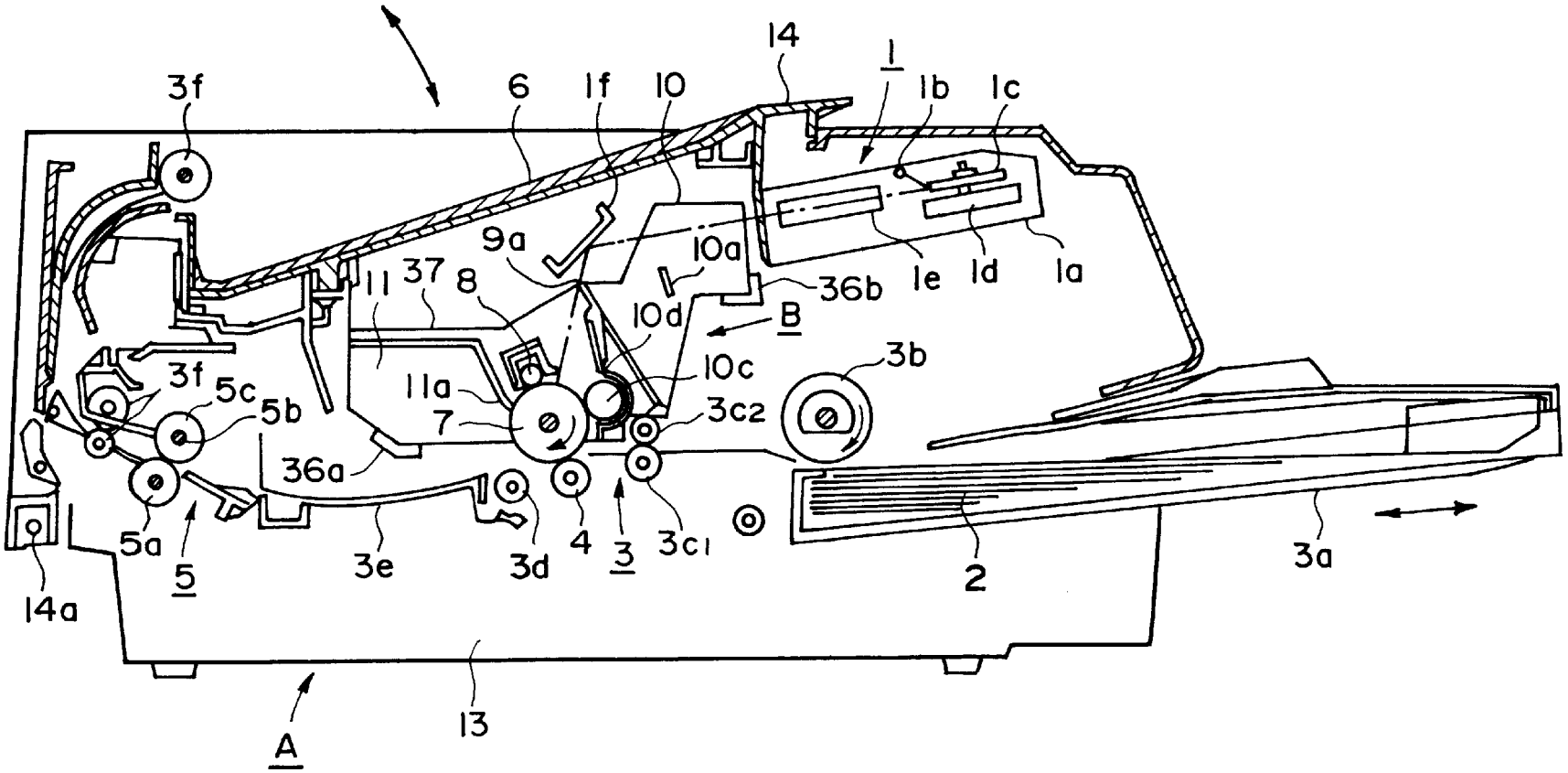
FIG. 1 shows a general arrangement of an image forming apparatus loaded with the process cartridge according to an embodiment of the present invention.
Figure 2:
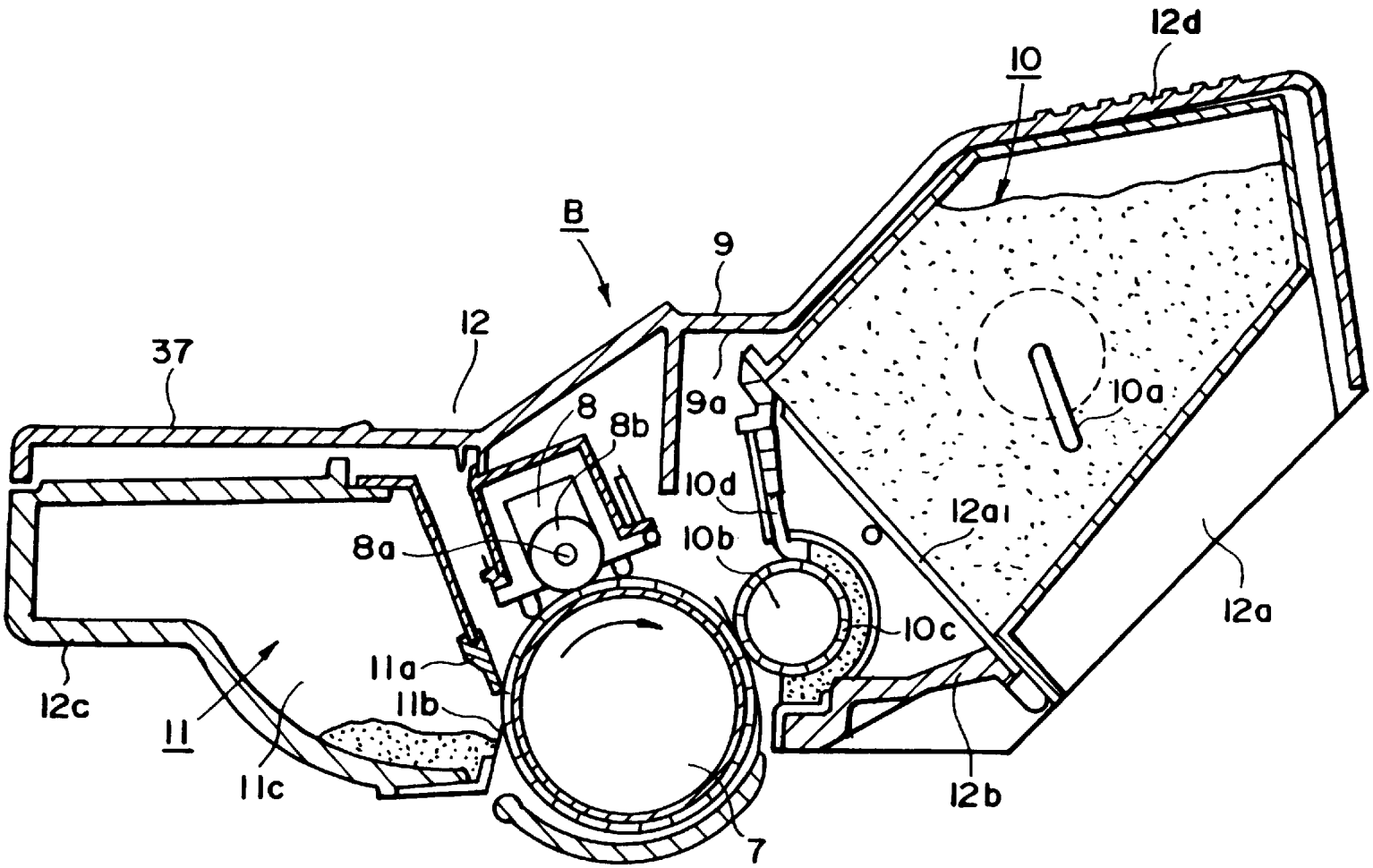
FIG. 2 is a sectional view of the process cartridge.

FIG. 1 is a sectional view of an image forming apparatus loaded with a process cartridge, according to an embodiment of the present invention. FIG. 2 is a sectional view of the process cartridge.

General Description

The image forming apparatus A, as shown in FIG. 1, projects light image bearing image information from an optical system 1 to a photosensitive drum 7 which is an example of the image bearing member, and a developed image is formed on the photosensitive member. In synchronism with the toner image formation, the recording material 2 is fed by feeding means 3, past an image forming station which is in the form of a cartridge (process cartridge B), the toner image is transferred onto a recording material from the photosensitive drum 7 by transfer means 4. The recording material 2 is fed to fixing means 5, where the toner image is fixed on the recording material, and the recording material is discharged to a discharge station.

A process cartridge B constituting the image forming station, as shown in FIG. 2, is such that the photosensitive drum 7 is rotated while the surface thereof is uniformly charged by charging means 8, and the light image from the optical system 1 is projected onto the photosensitive drum 7 through the exposure station 9, so that a latent image is formed. The latent image is developed into a toner image by developing means 10. The toner image is transferred therefrom onto the recording material 2 by the transfer means 4, and thereafter, the residual toner remaining on the photosensitive drum 7 is removed by cleaning means 11. Various parts such as the photosensitive drum 7 or the like are mounted on a toner container 12*a*, developing device frame 12*b* and a cleaner frame 12*c*, and they are unified in the housing, so that they constitute a cartridge.

The description will be made as to various parts of the image forming apparatus A and the process cartridge B. The description will be further made as to a sealing member mounted to a toner container 12*a* around an opening thereof, and a mounting method therefor.

Image Forming Apparatus The description will be made as to an optical system, feeding means, transfer means, fixing means and cartridge mounting means in this order.

Optical System

The optical system produces the light beam carrying image information provided by an external apparatus or the like, onto the photosensitive member drum 7. As shown in FIG. 1, it comprises an optical unit in the main assembly 1*a* containing a laser diode 1*b*, a polygonal mirror 1*c*, a scanner motor 1*d* and an image forming lens 1*e*.

When an image signal is sent from an external equipment such as a computer or word processor, the laser diode 1*b* emits light in response to the imaging signal, and the emitted light is projected as the imaging beam to the polygonal mirror 1*c*, which is being rotated at a high speed by a scanner motor 1*d*. The imaging beam reflected by the polygonal mirror 1*c* is projected through the image forming lens 1*e* and is effected by the mirror 1*f* onto the photosensitive drum 7, exposing selectively the surface thereof. As a result, a latent image is formed on the drum in accordance with the image information.

Recording Material Feeding Means

The description will be made as to the structure of feeding means 3 for feeding the recording material (recording sheet, OHP sheet, cloth or thin sheet, for example).

The topmost sheet in cassette 3*a* is fed by a pick-up roller 3*b* and is fed to a registration roller pair 3*c*1 and 3*c*2. The registration roller pair is driven in synchronism with the image forming operation to feed the recording material 2 to an image transfer position.

The recording material 2 having received the toner image is fed to image fixing means 5 along a guide 3*e* by feed roller 3*d*, where the toner image is fixed. Then it is discharged to a discharge portion 6 by a discharging roller pair 3*f* with the recorded side facing down.

Transfer Means

The transfer means 4 transfers the toner image formed on the photosensitive drum 7 onto a recording material 2. The transfer means 4 of this embodiment, as shown in FIG. 1, is constituted by a transfer roller 4. By the transfer roller 4 the recording material 2 is pressed to the photosensitive drum 7 in the process cartridge B, while the transfer roller 4 is supplied with a voltage having a polarity opposite to that of the toner image formed on the photosensitive drum 7, so that the toner image is transferred onto a recording material 2 from the photosensitive drum 7.

Fixing Means

The fixing means 5 functions to fix the toner image having been transferred by the voltage applied to the transfer roller 4. As shown in FIG. 1, the fixing means 5 comprises a driving roller 5*a*, and an inside heater 5*b* and a fixing roller 5*c* driven by the driving roller 5*a* by the press-contact therebetween. When the recording material 2 having the toner image passes through a nip formed between the driving roller 5*a* and the fixing roller 5*c*, the pressure is applied by the nip between the rollers 5*a* and 5*c*, while being subjected to heat produced by the fixing roller 5*c*, by which the toner image is fixed on the recording material 2.

Process Cartridge Mounting Means

In the image forming apparatus A, there is provided a cartridge mounting means for securely receiving the process cartridge B. As shown in FIG. 1, the mounting or demounting of the process cartridge B relative to the main assembly 13 is effected after opening the opening member 14. The upper part of the main assembly 13 is provided with an opening member 14 operable by a hinge 14*a*. The opening member 14 is opened, and the cartridge is inserted along guides 36*a* and 36*b* into the cartridge receiving space in the main assembly 13. Then, the opening member 14 is closed, and the process cartridge B is mounted to the image forming apparatus A.

Process Cartridge

The description will be made as to the process cartridge B mounted to the image forming apparatus A.

This process cartridge B comprises an image bearing member and at least one processing means. As for the processing means, there are for example, a charging means for charging the surface of the image bearing member, a developing means for forming a toner image on the image bearing member, a cleaning means for cleaning the residual toner from the image bearing member surface, or the like. The process cartridge B of this embodiment comprises an electrophotographic photosensitive drum 7 as the image bearing member, a charging means 8, an exposure means 9, a developing means 10, and cleaning means 11, wherein the photosensitive drum 7 is surrounded thereby, as shown in FIG. 2. The processing means is integrally contained in a housing 12 comprising a toner container 12*a*, a developing device frame 12*b* and a cleaner frame 12*c*, thus forming an exchangeable cartridge which can be loaded into or taken out of the main assembly of the apparatus.

The parts of the process cartridge B will be described in the order of photosensitive drum 7, charging means 8, exposure means 9, developing means 10 and cleaning means 11.

Photosensitive Drum

The photosensitive drum 7 in this embodiment comprises a drum base of cylindrical aluminum and an organic photoconductive layer applied thereon. The photosensitive drum 7 is mounted rotatably on the cleaner frame 12*c*. A flange gear mounted to one longitudinal end of the drum 7 is driven by a driving force from a driving motor provided in the main assembly, by which the photosensitive drum 7 is rotated in a direction indicated by an arrow in FIG. 2 in accordance with image forming operation.

Charging Means

Charging means 8 functions to uniformly charge the surface of the photosensitive drum 7, and in this embodiment, it is a so-called contact charging type in which a charging roller 8*b* is rotatably mounted on a cleaning container 12*c*. The charging roller 8*b* comprises a metal roller shaft 8*a*, an electroconductive elastic layer thereon, a high resistance elastic layer and a surface protection layer. The electroconductive elastic layer comprises a carbon dispersed in elastic rubber layer of EPDM or NBR or another elastic rubber layer. It is effective to introduce a bias voltage from the roller shaft 8*a*. The high resistance elastic layer is of urethane rubber or the like, and as an example, it contains a small amount of electroconductive fine powder. It is effective to limit leakage current to the photosensitive drum 7 to prevent a sudden bias voltage drop even when the charging roller 8*b* is contacted to a high electroconductivity portion such as a pin hole of the photosensitive drum 7. The protection layer is constituted by N-methylmethoxynylon, so that plastic material in the high resistance elastic layer or in the electroconductive elastic layer is directly contacted to the photosensitive drum 7 to not deteriorate the surface of the photosensitive drum 7.

The charging roller 8*b* is contacted to the photosensitive drum 7, and for the image formation, the charging roller 8*b* is driven by the rotation of the photosensitive drum 7, and the superimposed application of the DC voltage and the AC voltage to the charging roller 8*b* is effective to uniformly charge the surface of the photosensitive drum 7.

Exposure Means

The exposure means 9 is effective to expose the surface of the photosensitive drum 7 uniformly charged by the charging roller 8*b* by a light image supplied from an optical system 1, thus forming an electrostatic latent image on the surface of the drum 7. An opening 9*a* for introducing the light image formed in the top surface 37 of the housing 12 constitutes the exposure means 9.

Developing Means

As shown in FIG. 2, the developing means 10 comprises a toner container 12*a* for containing toner, and toner feeding member 10*a* rotatable to feed the toner. The developing device frame 12*b* mounted to an opening 12*a*1 side of the toner container 12*a* is provided with a developing sleeve 10*c* for forming thereon a thin toner layer with a non-rotatable magnet 10*b* therein.

When the toner layer is to be formed on the surface of the developing sleeve 10*c*, the toner and the developing sleeve 10*d* are contacted to triboelectrically charge the toner to a sufficient extent to develop the latent image on the photosensitive drum 7. In order to regulate the layer thickness of the toner, there is provided a blade 10*d*, as shown.

Cleaning Means

The cleaning means 11, as shown in FIG. 2, comprises a cleaning blade 11*a* for scraping toner off the drum 7 by contact to the surface thereof, a receptor sheet 11*b* disposed below the blade 11*a* lightly contacted to the surface of the photosensitive drum 7 to receive the toner scraped by the cleaning blade 11*a*, and a residual toner container 11*c* for containing the removed residual toner.

Sealing Structure for the Toner Container

The description will be made as to a structure for sealing the opening 12*a*1 of the toner container 12*a*. In the process cartridge B, the sealing structure is different for a new or fresh cartridge than for a remanufactured cartridge which is to be used after a previous use.

Sealing Structure for a Fresh Cartridge

Figure 3:
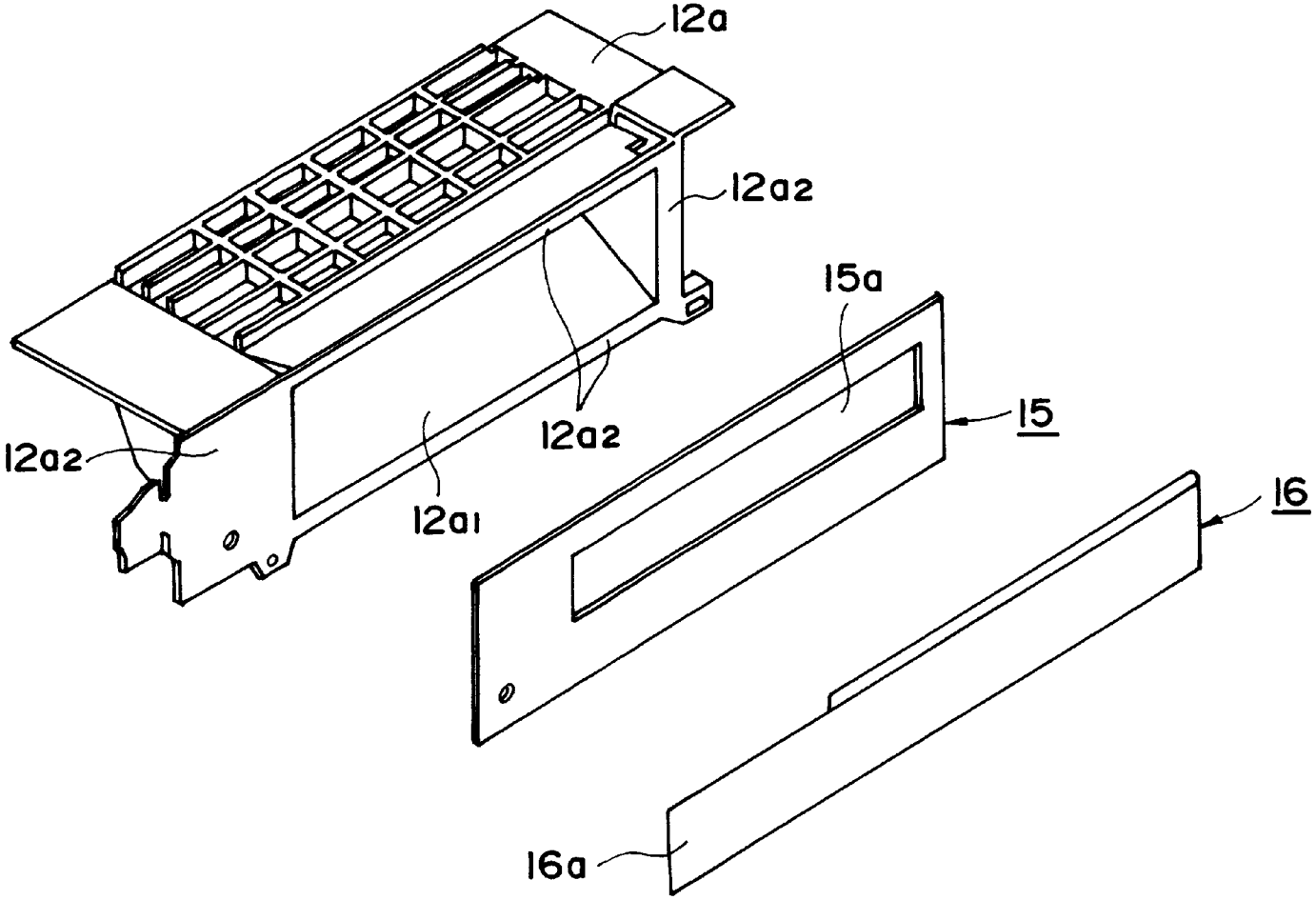
FIG. 3 is an exploded view of a toner container, an opening limiting member and a sealing member.

The opening 12*a*1 of the toner container 12*a* is sealed by a sealing member, so that the toner is prevented from leaking through the opening 12*a*1 during transportation of the cartridge B. As shown in FIG. 3, an opening limiting member 15 for limiting the opening area is mounted to the opening 12*a*1 portion of the toner container 12*a*. In this embodiment, the opening 15*a* of the opening limiting member 15 is sealed by a sealing member 16.

By properly selecting the size of the opening 15*a* of the opening regulating member 15, the amount of the toner supplied from the toner container 12*a* to the developing sleeve 10*c* is regulated. The opening limiting member 15 is made of polyester plate, polystyrene plate, nylon plate, ABS plate or another plastic plate having a thickness of approx. 0.3–2 mm, formed into a sheet. It is punched to provide the opening 15*a*. This is mounted to a flange 12*a*2 provided adjacent the opening 12*a*1 of the toner container 12*a*, by ultrasonic wave fusing or the like. The sealing member 16 of polyethylene film, polypropylene film or the like is heat-sealed to cover the opening 15*a* of the opening limiting member 15, and a free end 16*a* thereof is folded back.

Figure 4:
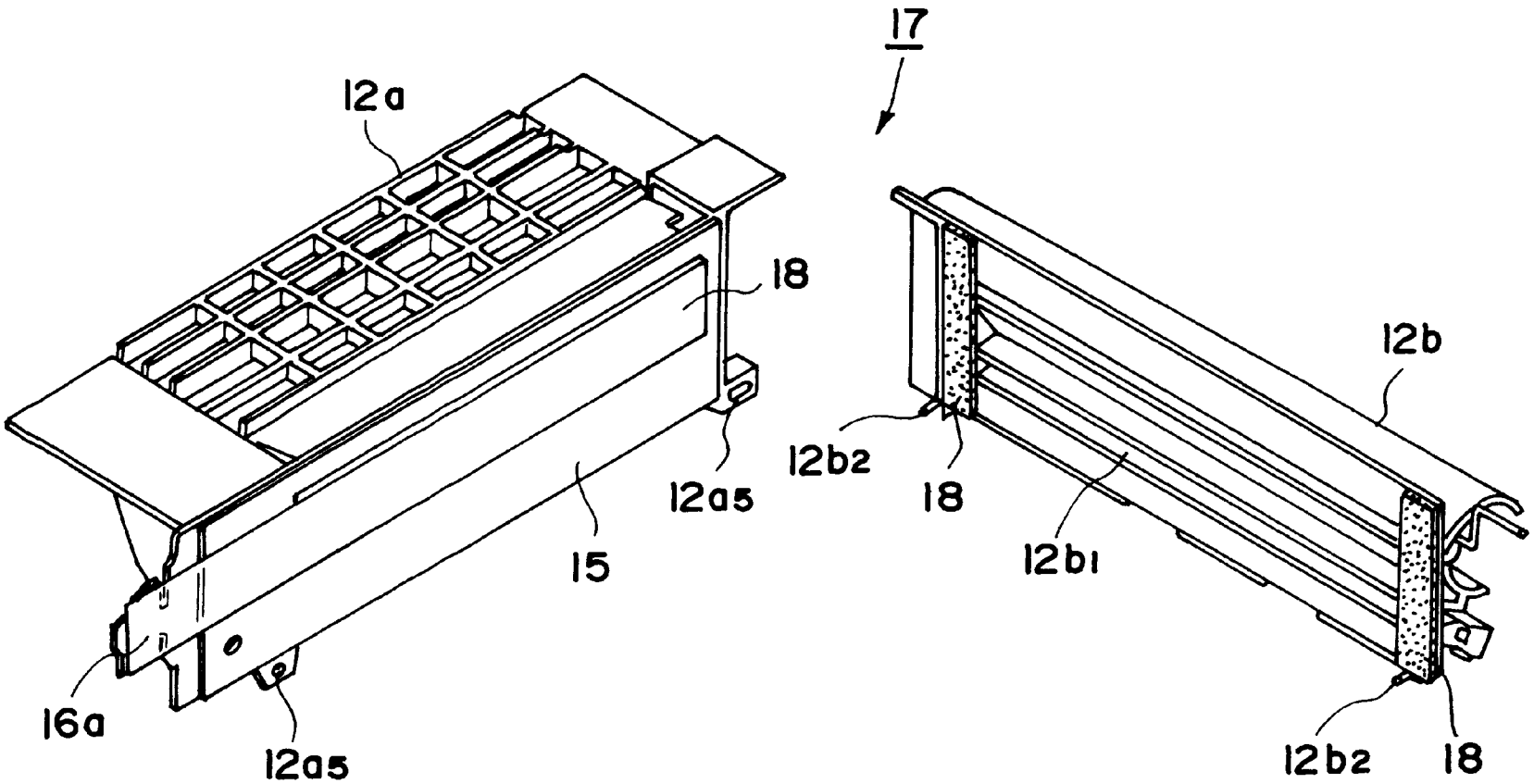
FIG. 4 is an exploded view of the toner container and a developing device frame.

As shown in FIG. 4, the developing device frame 12*b* is coupled with the toner container 12*a*. The developing device frame 12*b* functions to support thereon a developing sleeve 10*c* or a developing blade 10*d*, and is provided with a rectangular opening 12*b*1 for permitting supply of the toner from the toner container 12*a* to the developing sleeve 10*c*. The opening limiting member 15 is fused to both of the long sides of the opening 12*b*1 by ultrasonic wave fusing or the like. The free end 16*a* of the sealing member 16 is exposed from one of short sides. In this manner, the toner container 12*a* and the developing frame 12*b* are fused to constitute non-separable developing unit 17. Upon the coupling between the developing device frame 12*b* and the toner container 12*a*, projections 12*b*2 of the developing frame 12*b* are engaged with holes 12*a*5 of the toner container 12*a*, so that the relative positional relationship therebetween is correctly established. By the unification of the toner container 12*a* and the developing device frame 12*b* by the use of the ultrasonic wave bonding, the toner leakage therebetween can be prevented, and it is desirable.

The long sides of the opening limiting member 15 and the developing frame 12*b* are fused, and therefore, there is no possibility of toner leakage therebetween. However, the short sides are unable to be fused because pulling of the sealing member 16 has to be permitted. Therefore, slits are produced on the short sides, and therefore, there occurs a possibility of toner leakage. Therefore, end seal 18 is provided at each of the short ends of the developing frame 12*b*, so as to prevent the toner leakage.

When the process cartridge B sealed at the opening 15*a* is used, the operator pulls the free end 16*a* of the sealing member 16 exposed between the toner container 12*a* and the developing frame 12*b*, prior to the mounting of the process cartridge B to the main assembly 13. Then, the sealing member 16 is peeled off the opening limiting member 15. This permits the toner to be supplied from the container 12*a* to the developing sleeve 10*c*.

Here, the new or fresh process cartridge means the one manufactured by fresh parts without using used parts, and a remanufactured process cartridge is the one manufactured at least partly with used parts or part, and toner is reloaded.

Sealing Structure for the Remanufactured Cartridge

The description will be made as to the case in which a used cartridge is collected, and is disassembled, whereafter the toner is reloaded into the toner container 12*a*. First, disassembling process will be described, and the method of sealing the opening of the toner container 12*a* will be described.

Figure 5:
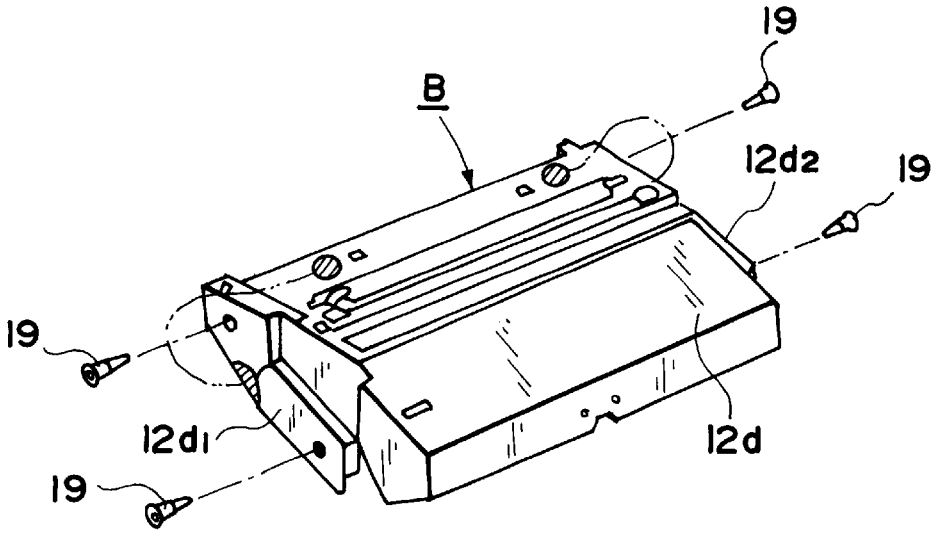
FIG. 5 illustrates demounting of the housing frame.
Figure 6:
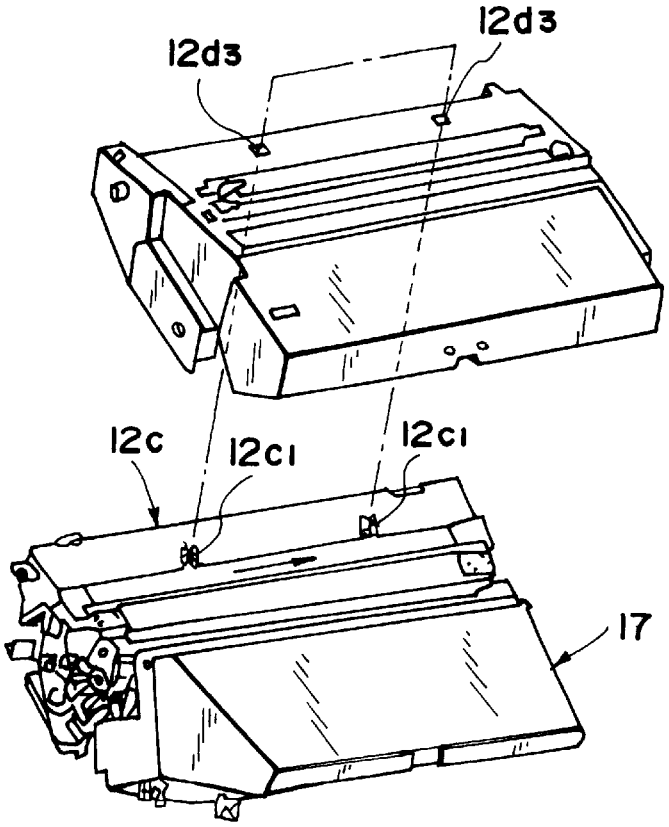
FIG. 6 is an exploded view when the housing frame is separated from the developing unit and the cleaner container.

As shown in FIG. 5, for the process cartridge B, four pins 19 (2 at the left and 2 at the right) fixing the left and right wall portions 12*d*1 and 12*d*2 of the housing frame 12*d* on the developing unit 17 and the cleaning container 12*c*, are removed. Subsequently, as shown in FIG. 5, left and right end portions of the housing frame 12*d* are gripped by hands (chain lines) in the manner that thumbs push down the top hatched portions and then remaining fingers urge outwardly the lower hatched portions (only one side is shown in FIG. 5) of the left and right walls 12*d*1 and 12*d*2 of the housing frame 12*d*. Then, the upper part is raised, by which, as shown in FIG. 6, the engagement between claws 12*c*1 on the top of the cleaning frame 12*c* and the engaging holes 12*d*3 of the housing frame 12*d*, are released, and therefore, the housing frame 12*d* is removed from the cleaning container 12*c*. The housing frame 12*d* is blown with air in an air duct so that foreign matters such as toner, dust and the like deposited on the outer or inner surfaces are removed to permit reuse.

Figure 7:
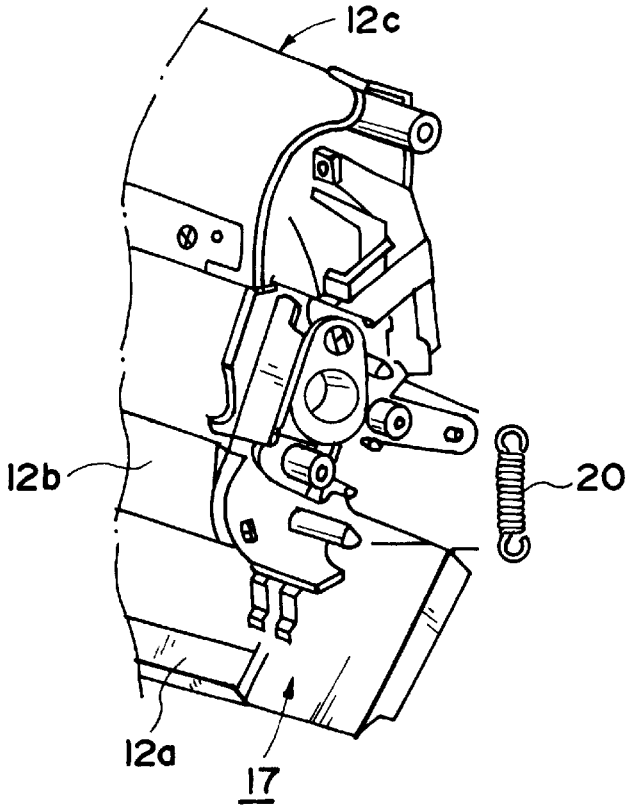
FIG. 7 illustrates a state in which a spring between the developing unit and the cleaner container is removed.
Figure 8:
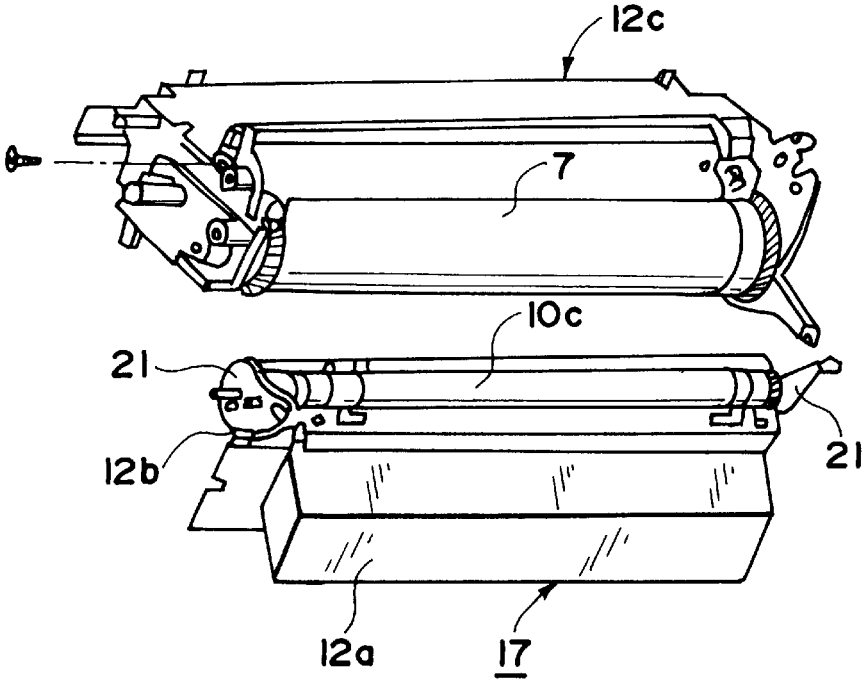
FIG. 8 shows a state in which the developing unit and the cleaner container are separated from each other.

Subsequently, as shown in FIG. 7, springs 20 (only one spring is shown in FIG. 7) which are disposed at the left and right ends of the developing device frame 12*b* and the cleaner frame 12*c* and which function to urge the developing sleeve 10*c* of the developing device frame 12*b* toward the photosensitive drum 7 in the cleaner frame 12*c*, are removed. Then, as shown in FIG. 8, the connection of arms 21 threaded to the left and right ends of the developing frame 12*b* with the cleaning container 12*c*, is released. As a result of the series of disassembling steps, the developing unit 17 can be taken out.

Before disassembling the developing unit 17, it is first cleaned. In this cleaning, a cap 12*a*4 (FIG. 9) fixed to a toner supply port 12*a*3 (FIG. 9) of the toner container 12*a*, for example, is removed, and a hose (not shown) connected with a sucking device (not shown) is inserted through the toner supply port 12*a*3 to suck out the toner remaining in the inside of the toner container 12*a* and the inside of the developing frame 12*b*.

Figure 9:
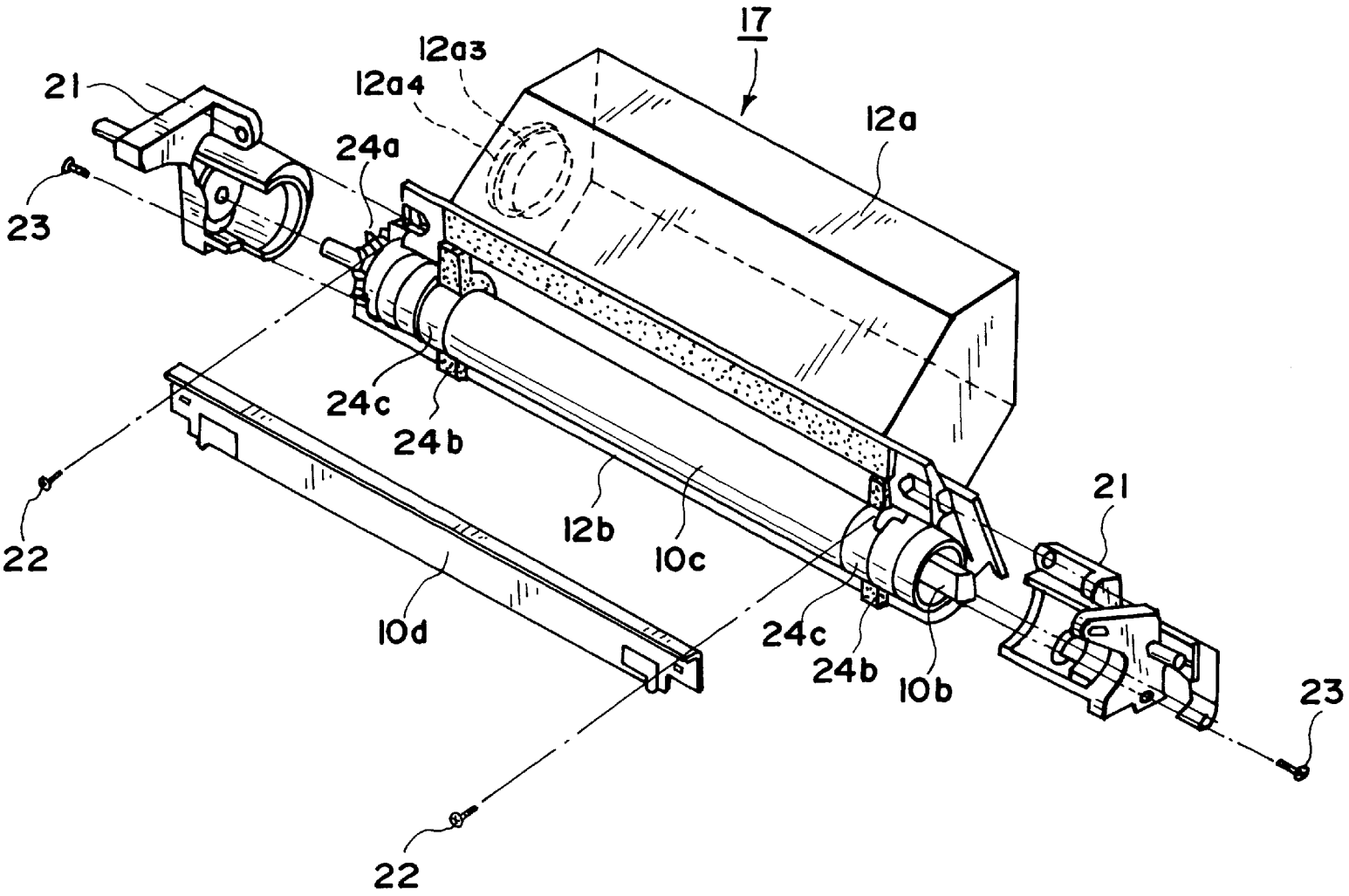
FIG. 9 illustrates a state in which a developing blade and an arm are removed from the developing unit.

After this cleaning, the developing unit 17 is disassembled. As shown in FIG. 9, screws 22 are removed, and the developing blade 10*d* is removed. Further, the screws 23 at the left and right ends, are unthreaded, and the left and right arms 21 are pulled out. Then, the developing sleeve 10*c* and the magnet 10*b* mounted to the developing frame 12*b* are removed. Further, the developing sleeve 10*c* is disassembled into parts. The parts are classified into reusable parts including a sleeve gear 24*a*, bearings 24*b* and the magnet 10*b*, and non-reusable parts to be replaced with fresh parts, including the developing sleeve 10*c*, a roller 24*c* and a sleeve electrode (not shown). The reusable parts are cleaned by air blow or the like.

Figure 10:
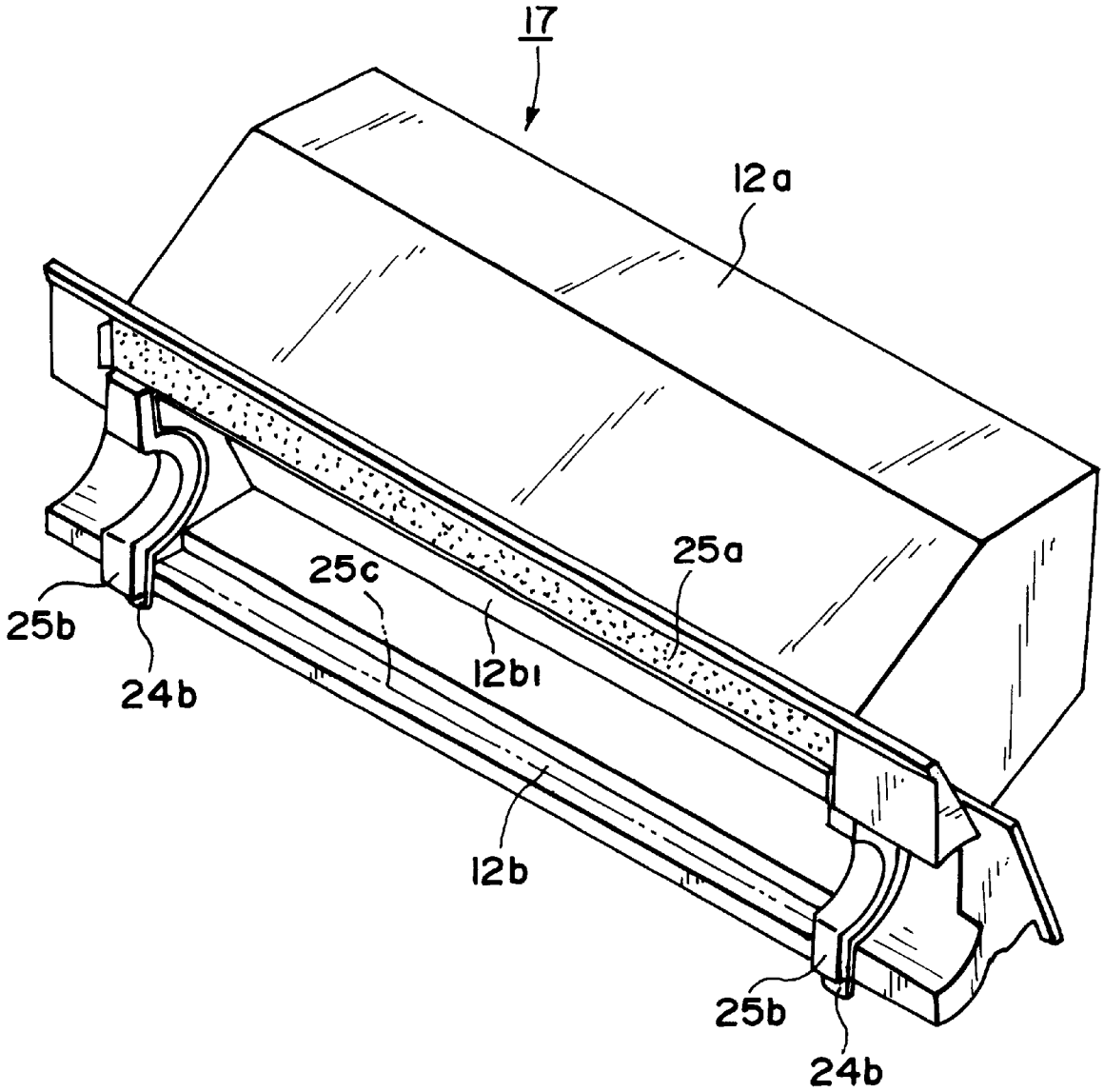
FIG. 10 illustrates a state in which a developing slit is removed from the developing unit.

As shown in FIG. 10, the long side seal 25*a*, the short side seals 25*b* bonded by duplicated adhesive tape on the developing device frame 12*b*, and the film 25*c* at the bottom of the developing device frame 12*b* (chain lines in FIG. 10), are removed. The adhesive material remaining on the developing frame 12*b* is removed, and thereafter, the cleaning is effected with the air or the like. Then, fresh long side seals 25*a*, the short side seals 25*b* and the film 25*c* are bonded by duplicated adhesive tapes, thus resealing the opening 12*a*1 of the toner container 12*a*.

The description will be made as to the resealing member for re-sealing the opening 12*a*1 and the toner container 12*a* and a re-sealing method.

Figure 11A:
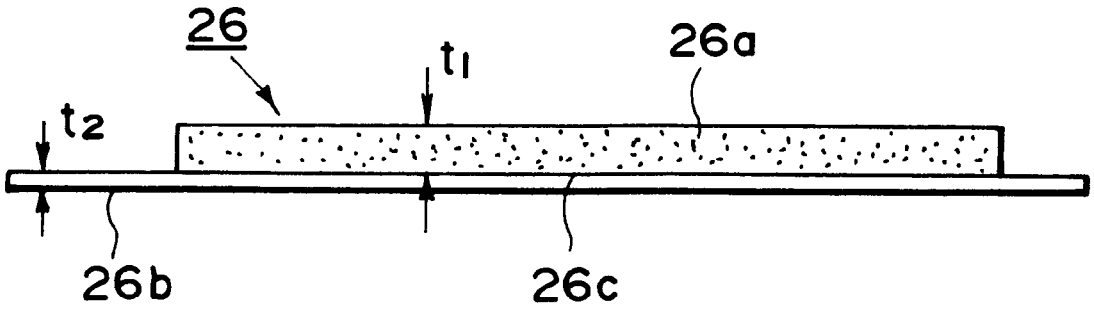
FIG. 11A is a sectional view of the re-sealing member.
Figure 11B:
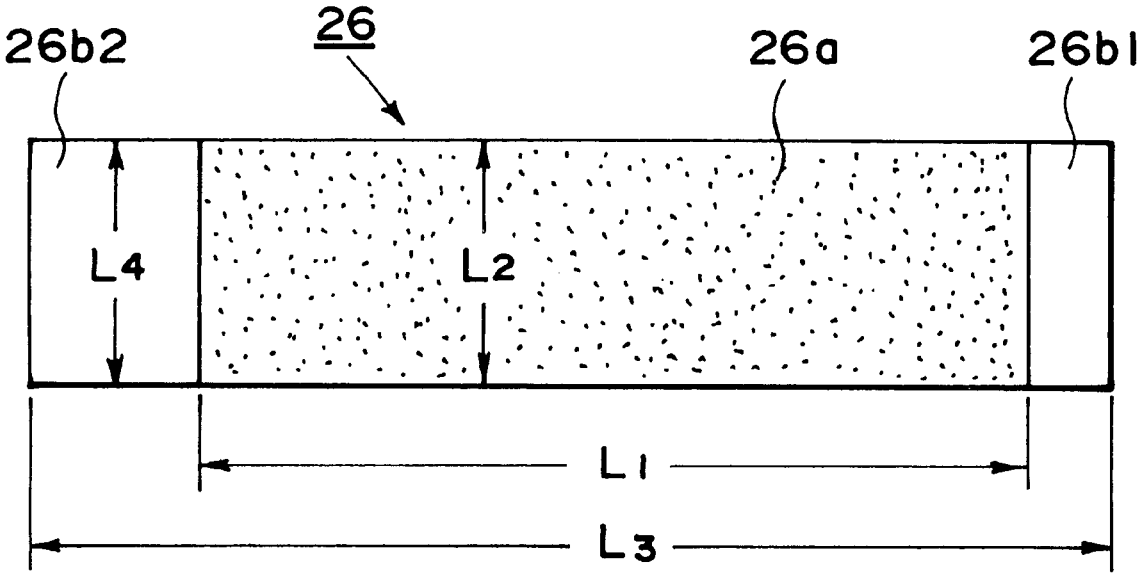
FIG. 11B is a plan view of the re-sealing member.

The re-sealing member according to this embodiment is different from the sealing member 16 for a fresh cartridge. As shown in FIG. 11A and FIG. 11B, a flexible sheet or film 26*b* is adhered to an elastic sheet 26*a* by an adhesive or by duplicated adhesive tape 26*c* or the like. As for the material of the elastic sheet 26*a*, preferable materials include foamed urethane material, foamed polyethylene material, silicone rubber or the like. Among them, the foamed polyurethane material is particularly preferable because the permanent compression deformation is small, the sealing property is not deteriorated, and the sliding property is good. More particularly, a high density foamed polyurethane material having a hardness of 20–70 degrees, a permanent compression deformation of not more than 4%, a friction coefficient of not more than 0.8, a cell size of 60–300 $\mu$m, and a specific gravity of 0.2–0.5, is preferably used with 5–50% compression. The high density foamed polyurethane is preferably Poron available from Inoac Corporation.

The preferable materials for the flexible sheet 26*b* include polyester, drawn polypropylene, nylon, polyethylene or the like. Among them, the polyester is particularly preferable because of the high tensile strength despite the small thickness thereof. The elastic material sheet 26*a* constitutes a main part of the re-sealing member 26. By the elastic compression deformation of the elastic sheet 26*a*, the opening is closed. The flexible sheet 26*b* also functions to reinforce the elastic sheet 26*a* to prevent tearing thereof when the user pulls the resealing member 26 prior to the start of use of the remanufactured cartridge. It extends to both of the long sides of the elastic sheet 26, and one side functions as an engagement when the re-sealing member 26 is inserted, and the other end functions as a grip 26*b*2 for pulling out the re-sealing member 26.

The dimensions of the parts of the re-sealing members 26 are as follows:

elastic sheet 26*a*: L1×L2=245 mm×43 mm, thickness t1=1 mm flexible sheet 26*b*: L3×L4=445 mm×43 mm, thickness t2=0.1 mm.

Figure 12A:
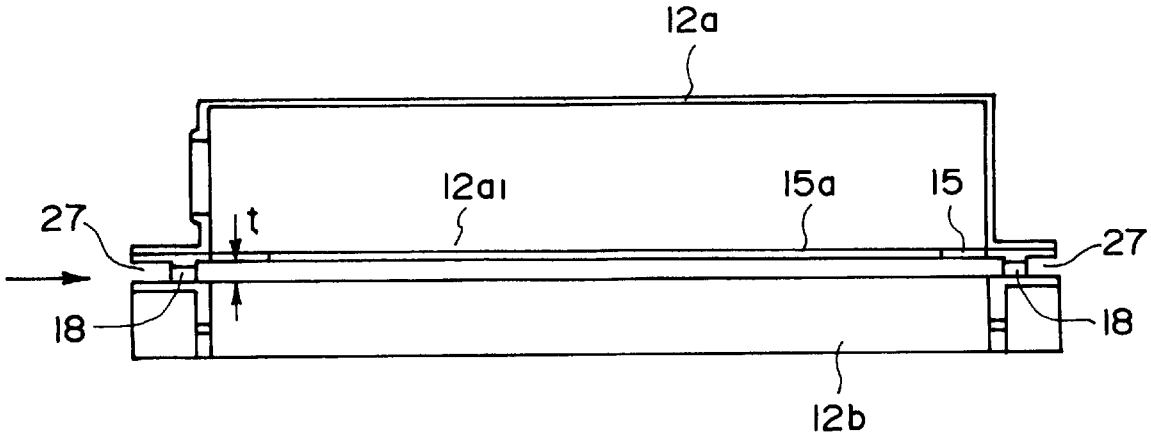
FIG. 12A is a sectional view of the toner container and the developing frame.
Figure 12B:
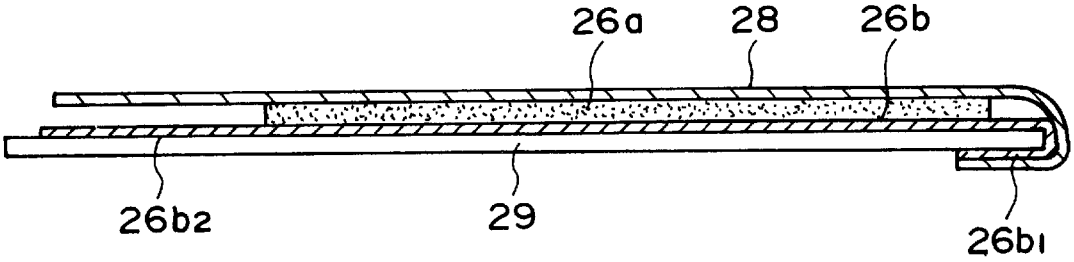
FIG. 12B is a sectional view in which the re-sealing member is overlaid on an insertion plate.

As shown in FIG. 12A, the re-sealing member 26 is inserted in a direction indicated by an arrow through a slit 27 between the toner container 12*a* and the developing device frame 12*b*, while the opening 12*a*1 of the toner container 12*a* is faced down. In order to facilitate the insertion by reducing the insertion resistance of the re-sealing member 26 at this time, the re-sealing member 26 is sandwiched between a sliding sheet 28 and an insertion plate 29, as shown in FIG. 12B. They are forcedly inserted through the slit 27.

The sliding sheet 28 may be of paper or plastic film coated with silicone or Teflon wax, for example, exhibiting good sliding property relative to the opening limiting member 15 and/or the developing frame 12*b*. The insertion plate 29 is preferably spring steel, stainless steel, for example, which is thin and is not easily bent.

The sliding sheet 28 used in this embodiment has a size of 445 mm×43 mm and a thickness of 0.6 mm coated with silicone wax. The insertion plate 29 has a size of 300 mm×40 mm, and a thickness of 0.2 mm made of spring steel. The gap t of the slit 27 is 1 mm.

Figure 13A:
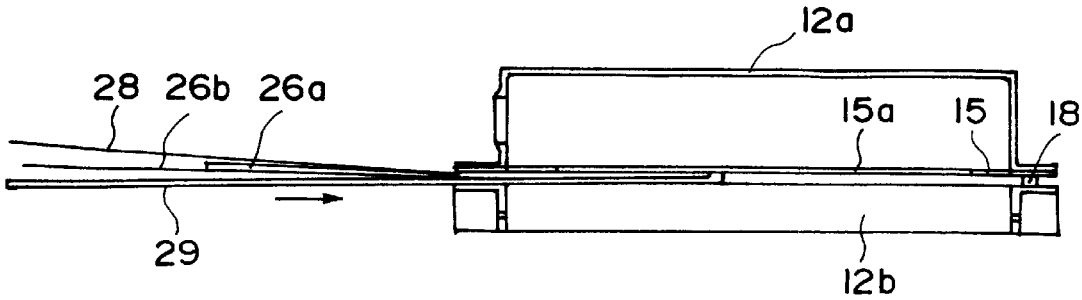
FIG. 13A shows a state in which the resealing member is partly inserted into a slit by the insertion plate.

The re-sealing member mounting method is as follows. As shown in FIG. 12B, the sliding sheet 28 is overlaid on the elastic sheet 26*a* of the re-sealing member 26, and the flexible sheet 26*b* of the resealing member 26 is overlaid on the insertion plate 29. In other words, the re-sealing member 26 is interposed between the sliding sheet 28 and the insertion plate 29, and an engaging portion 26*b*1 of the flexible sheet 26*b* and the end portion of the sliding sheet 28 are folded back over an end of the insertion plate 29. With the state maintained, as shown in FIG. 13A, they are inserted into the slit 27 with the sliding sheet 28 near the opening limiting member 15 and the insertion plate 29 near the developing device frame 12*b*.

The thickness of the elastic sheet 26*a* is larger than the slit gap, but the forced insertion using the insertion plate 29 compresses the elastic sheet 26*a*, and by the sliding property of the sliding sheet 28, the re-sealing member 26 is inserted through the slit 27 between the opening limiting member 15 and the developing frame 12*b*.

Figure 13B:
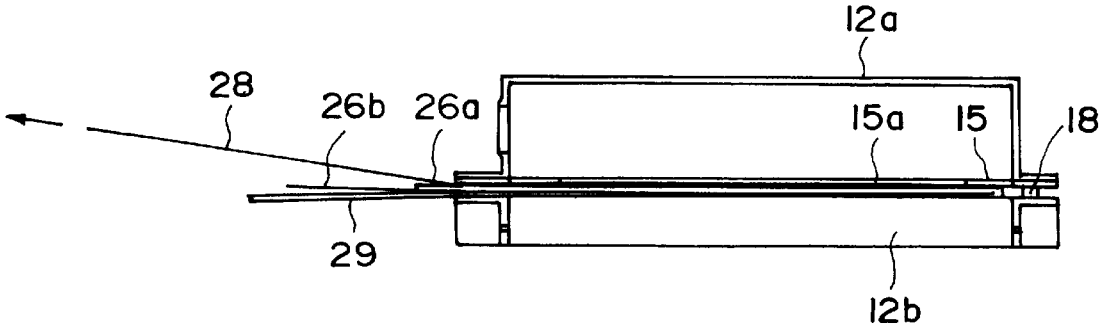
FIG. 13B shows a state in which a sliding sheet is pulled out.

As shown in FIG. 13B, the inserting action is temporarily stopped immediately before the leading end of the insertion plate 29 reaches the end seal 18 at the rear side. Then, only the sliding sheet 28 is pulled out. This is because it becomes difficult to pull the sliding sheet 28 out after the sliding sheet 28 is inserted through to the rear end seal 18.

Figure 13C:
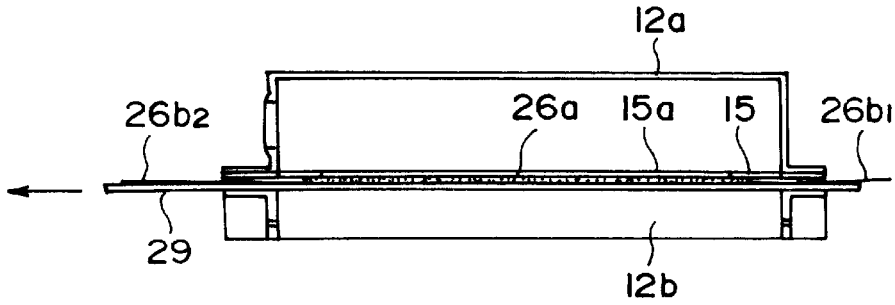
FIG. 13C illustrates a state in which the re-sealing member is completely inserted.
Figure 13D:
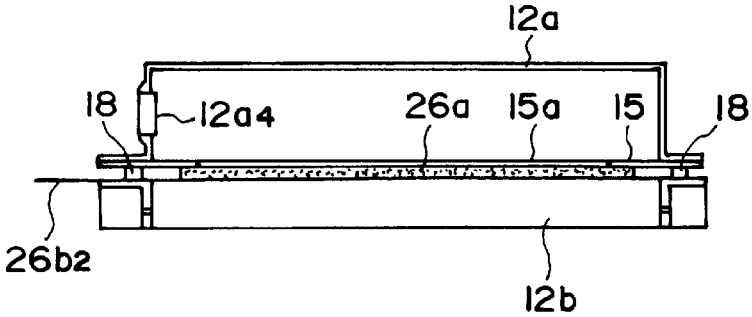
FIG. 13D shows a state in which the insertion plate is pulled out.

As shown in FIG. 13C, the leading end of the insertion plate 29 is projected out through the other end of the slit 27 to expose the engaging portion 26*b*1 of the flexible sheet 26*b*. Then, as shown in FIG. 13D, the insertion plate 29 is pulled out. The grip 26*b*2 and the engaging portion 26*b*1 of the flexible sheet 26 are gripped, and the position of the re-sealing member 26 is adjusted so that the elastic sheet 26*a* completely covers the opening 15*a* of the opening limiting member 15. Finally, the portion of the engaging portion 26*b*1 of the flexible sheet 26*b* exposed to the outside beyond the slit 27 is cut out.

When the elastic sheet 26 completely covers the opening 15*a*, it is compressed between the opening limiting member 15 and the developing frame 12*b*, and therefore, it is completely close-contacted to the edges of the opening 15*a*, thus assuredly closing the opening 15*a*. Then, the toner does not leak to the developing device frame 12*b* even if the toner is refilled in the toner container 12*a*.

The toner is supplied through the toner supply port 12*a*3 into the toner container 12*b* having the opening 15*a* thus sealed, and the toner supply port 12*a*3 is capped with a cap 12*a*4. The developing sleeve 10*c* or the like are mounted through the steps which are reverse to the disassembling steps. Thus, the process cartridge B is remanufactured. For this remanufacturing, consumption parts mechanically worn, members having deteriorated performance, or parts requiring readjustment, or the like, are preferably exchanged or readjusted to recover the properties or performance thereof. As for the consumption parts, there are seals or blades for preventing toner leakage and examples of performance deteriorated part include the photosensitive drum.

The process cartridge thus remanufactured has the performance equivalent to that of the process cartridge. Upon the start of the use, the grip 26*b*2 of the flexible sheet 26*b* is pulled out, thus pulling the re-sealing member 26 out, by which the toner in the toner container 12*a* can be supplied into the developing sleeve 10*c*. The removed re-sealing member 26 is not contaminated with the adhesive material or the like, and therefore, is reusable.

Figure 14A:
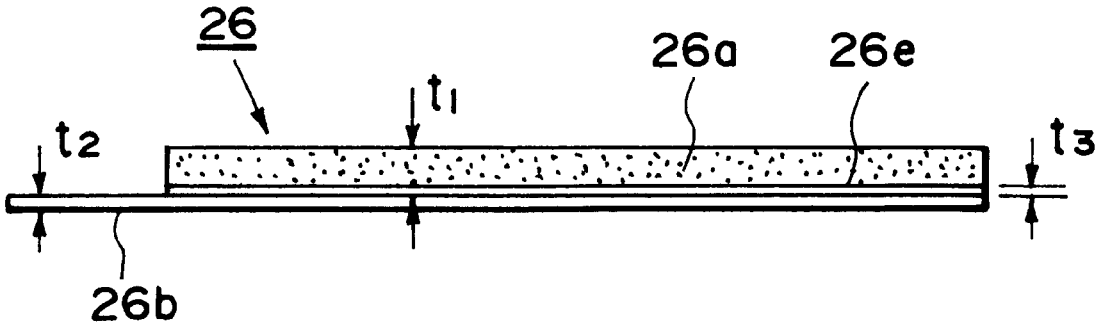
FIG. 14A is a sectional view of the resealing member.
Figure 14B:
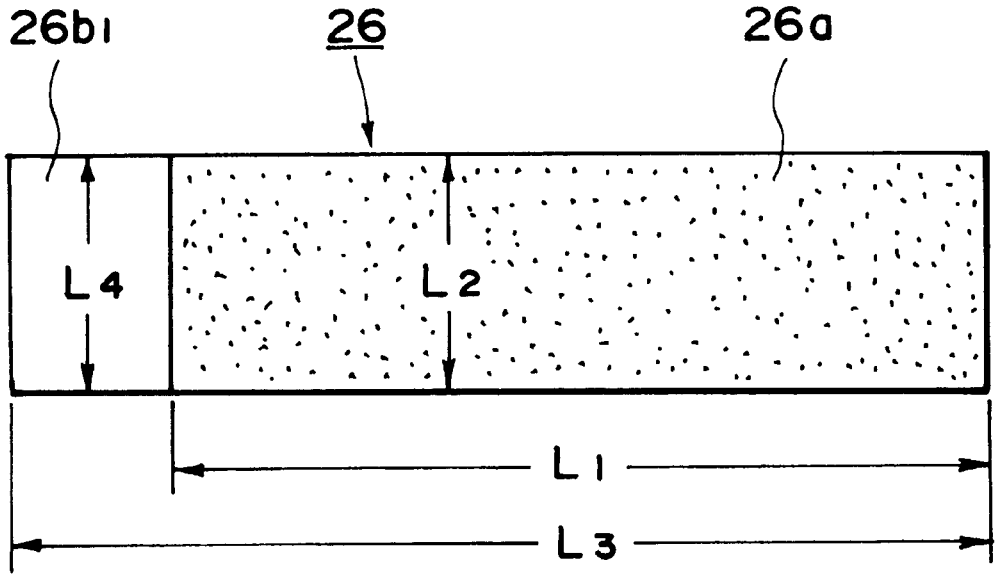
FIG. 14B is a top plan view of the resealing member.

Referring to FIGS. 14–15, a further embodiment will be described.

In this embodiment, a flexible sheet 26*b* is projected at one longitudinal end of the elastic sheet 26*a*, the projected portion functions as a grip 26*b*1 when the re-sealing member 26 is to be pulled out.

Therefore, the flexible sheet 26*b* is required to have a certain degree of tensile strength of approx. 2 kgf/15 mm–40 kgf/15 mm under JIS K7113 plastic tensile test value.

Examples of various dimensions preferable for the re-sealing member 26 in this embodiment are as follows. In FIG. 14, a length L1 of the elastic sheet 26*a* is approx. 220–240 mm; a width L2 is approx. 35–50 mm; a thickness t1 is 0.5–2 mm. As for the flexible sheet 26*b*, a length L3 is approx. 250–350 mm; a width L4 is approx. 35–50 mm; and a thickness t2 is 10–200 $\mu$m. In this embodiment, the elastic sheet 26*a* and the flexible sheet 26*b* are bonded by duplicated adhesive tape 26*e*, which has a thickness t1 of 50–500 $\mu$m.

For reference, the sealing member 26 of this embodiment is the same as described hereinbefore having the dimensions of L1=235 mm, L2=45 mm, t1=0.8–0.9 mm, L3=335 mm, L4=45 mm, t2=0.1 mm and t3=0.15 mm.

In this embodiment, the elastic sheet 26*a* and the flexible sheet 26*b* are bonded by the duplicated adhesive tape 26*e*. However, this is not limiting, and a bonding material or the like may be used. In this case, the thickness of the bonding layer is reduced as compared with the case of using the duplicated adhesive tape. In any case, the total thickness of the elastic sheet 26*a* and the flexible sheet 26*b* is larger than the gap of the slit 27.

The description will be made as to the process for mounting the re-sealing member 26 to the opening 12*a*1 of the toner container 12*a* by an operator.

Figure 15A:
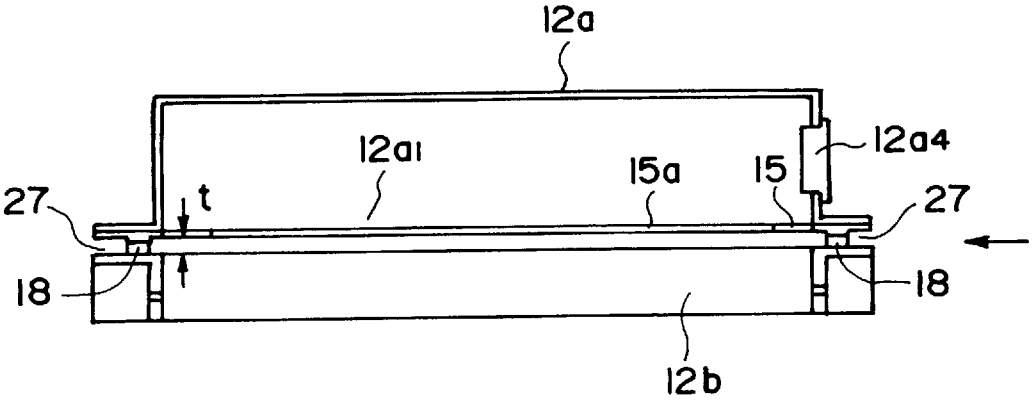
FIG. 15A is a sectional view of the toner container and the developing device frame.

As shown in FIG. 15A, the re-sealing member 26 is inserted in a direction indicated by an arrow through a slit 27 formed between the toner container 12*a* and the developing device frame 12*b*, while the opening 12*a*1 of the toner container 12*a* is faced down. At this time, the sealing member 26 per se is not hard enough to be inserted to the sleeve 27, and therefore, an insertion plate 29 shown in FIG. 12B is used. In order to improve the insertion operativity by reducing the insertion resistance, the use is made with a sliding sheet 28 to facilitate the forced insertion of the re-sealing member 26 into the slit 27.

Preferable dimensions of the insertion plate 29 in this embodiment are as follows. The length is approx. 275–400 mm, the width is approx. 40–45 mm, and the thickness is approx. 0.1–0.5 mm.

The size of the sliding sheet 28 is 685 mm×43 mm and 0.6 mm in thickness. It is made of paper coated with silicone wax. The insertion plate 29 has a size of 350 mm×40 mm, and a thickness of 0.2 mm, made of spring steel. The gap t of the slit 27 is 1 mm.

Figure 15B:
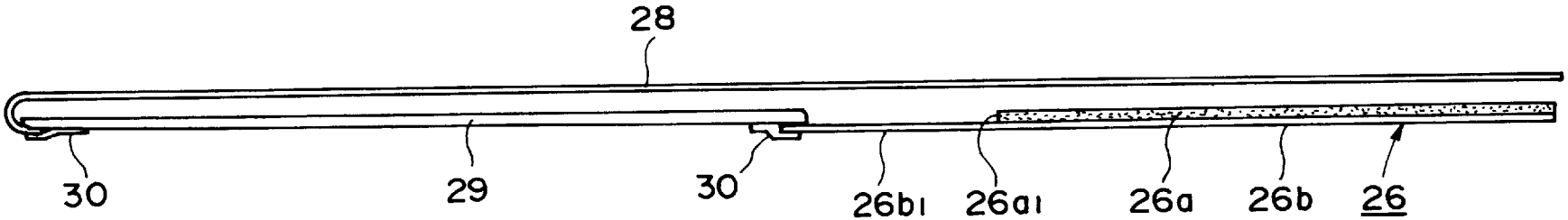
FIG. 15B shows a state in which the resealing member is mounted on the insertion plate.

The mounting steps of the re-sealing member 26 will be described. As shown in FIG. 15B, an end of the sliding sheet 26 is fixed using tape 30 at a longitudinal end (leading) of the insertion plate 29, and the sliding sheet 28 is folded back over the leading end of the insertion plate 29. On the other end of the insertion plate 29 (trailing end), a grip 26*b*1 of the flexible sheet 26*b* of the re-sealing member 26 is overlaid, and the gripping portion is fixed on the insertion plate 29 by a tape 30.

Figure 16A:
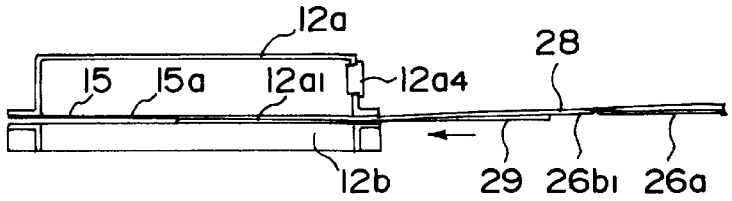
FIG. 16A shows a state in which the insertion plate is inserted into the slit.

The sliding sheet 28 is long enough to be overlaid on the insertion plate 29 and the elastic sheet 26*a* of the sealing member 26. With this state, as shown in FIG. 13A, it is inserted into one end of the slit with the sliding sheet 28 near the opening limiting member 15 and the insertion plate 29 near the developing device frame 12*b*. In this embodiment, as shown in FIG. 16A, the sliding sheet 28 is long enough to extend to the trailing edge of the elastic sheet 26*a* by way of the insertion plate 29, as a best example by which the friction resistance is reduced during the insertion. By doing so, the friction resistance upon the insertion of the sliding sheet 28 and the elastic sheet 26*a* into the slit 27 can be reduced. However, the sliding sheet 28 is preferably long enough to cover a leading end 26*a*1 of the elastic sheet 26*a* bonded to the flexible sheet 26*b*. By doing so, the impact when the end 26*a*1 (FIG. 15B) of the elastic sheet 26 abuts the slit 27 during the insertion, can be reduced. The use of the sliding sheet 28 is not inevitable if the materials of the insertion plate 29 and the elastic sheet 26*a* are properly selected, or if proper surface treatment is imparted.

Figure 16B:
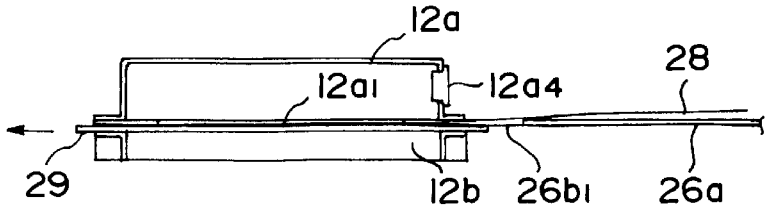
FIG. 16B shows a state in which a leading end of the insertion plate passes through the slit.

In this embodiment, the flexible sheet 26*b* is bonded on one side of the insertion plate 29, and the sliding sheet 28 is bonded on the other side. In this example, the thickness of the insertion plate 29 and the thickness of the elastic sheet 26*a* are overlaid, and therefore, it is easy to insert the elastic sheet 26*a*. However, the present invention is not limited to this example. For example, the flexible sheet 26*b* may be bonded on the top surface of the insertion plate 29 shown in FIG. 15B. By going so, a portion of the tape 30 for temporarily fixing the flexible sheet 26*b* on the insertion plate 29 is prevented from contact to the end seal 18. In the initial stage, the insertion plate 29 and the sliding sheet 28 are inserted into the slit 27 while they are overlaid, and as shown in FIG. 16B, the leading end of the insertion plate 29 is projected out of the other end of the slit 27. At this time, the sealing member 26 is not yet inserted into the slit 27.

Figure 16C:
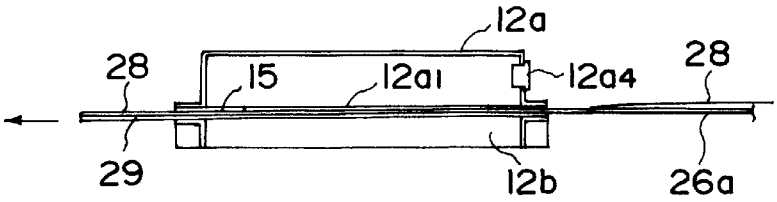
FIG. 16C illustrates a state in which the re-sealing member is pulled into the slit.

As the end of the insertion plate 29 projected out of the slit 27 is pulled out, as shown in FIG. 16C, the sealing member 26 fixed by the tape to the end of the insertion plate 29 is inserted into the slit 27. The thickness of the sealing member 26 is larger than the gap of the slit 27, but by the forced pulling of the insertion plate 29 and the sliding property of the sliding sheet 28, the elastic sheet 26*a* is inserted into the slit 27 while being compressed.

Figure 16D:
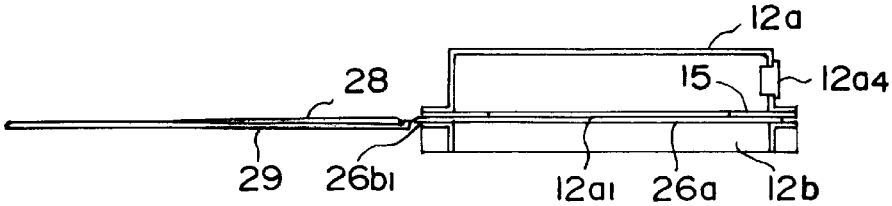
FIG. 16D shows a state in which the resealing member closes the opening.

As shown in FIG. 16D, the insertion plate 29 is completely pulled out through the slit 27, so that the grip portion 26*b*1 of the flexible sheet 26*b* is projected out of the slit 27. By doing so, the elastic sheet 26*a* of the sealing member 26 is inserted between the opening limiting member 15 and the developing device frame 12*b*, and the opening 15*a* of the opening limiting member 15 is closed.

By the complete covering of the elastic sheet 26*a* for the opening 15*a*, it is completely closely contacted to the edge portions of the opening 15*a* since the elastic sheet 26*a* is compressed between the opening limiting member 15 and the developing frame 12*b*. Thus, the opening 15*a* is assuredly sealed such that the toner does not leak to the developing frame 12*b* side even if the toner is supplied into the toner container 12*a*.

Figure 16E:
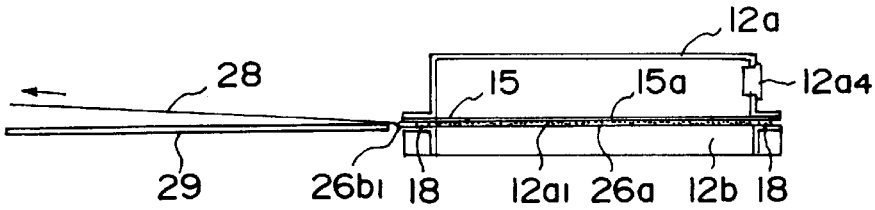
FIG. 16E illustrates a state in which the sliding sheet is pulled.
Figure 16F:
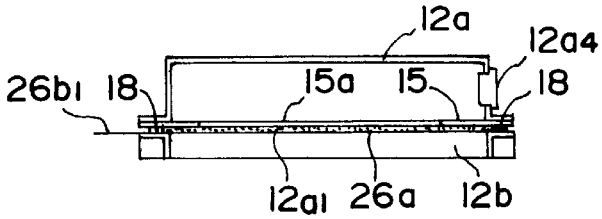
FIG. 16F shows a state in which the insertion plate is removed from the re-sealing member.

As shown in FIG. 16E, the tape 30 fixing the sliding sheet 28 to the insertion plate 29 is removed, and only the sliding sheet 28 is pulled out of the slit 27. After the position of the sealing member 26 is adjusted, the tape 30 fixing the flexible sheet 26*b* on the insertion plate 29 is removed as shown in FIG. 16F. Thus, the re-sealing is completed.

For the remanufacturing of the process cartridge B, the toner container 12*a* is refilled with the toner. For the refilling of the toner, there is a method in which the toner is supplied after the opening 15*a* is sealed by the sealing member 26, and a method in which the toner is supplied before the opening 15*a* is sealed.

Figure 17:
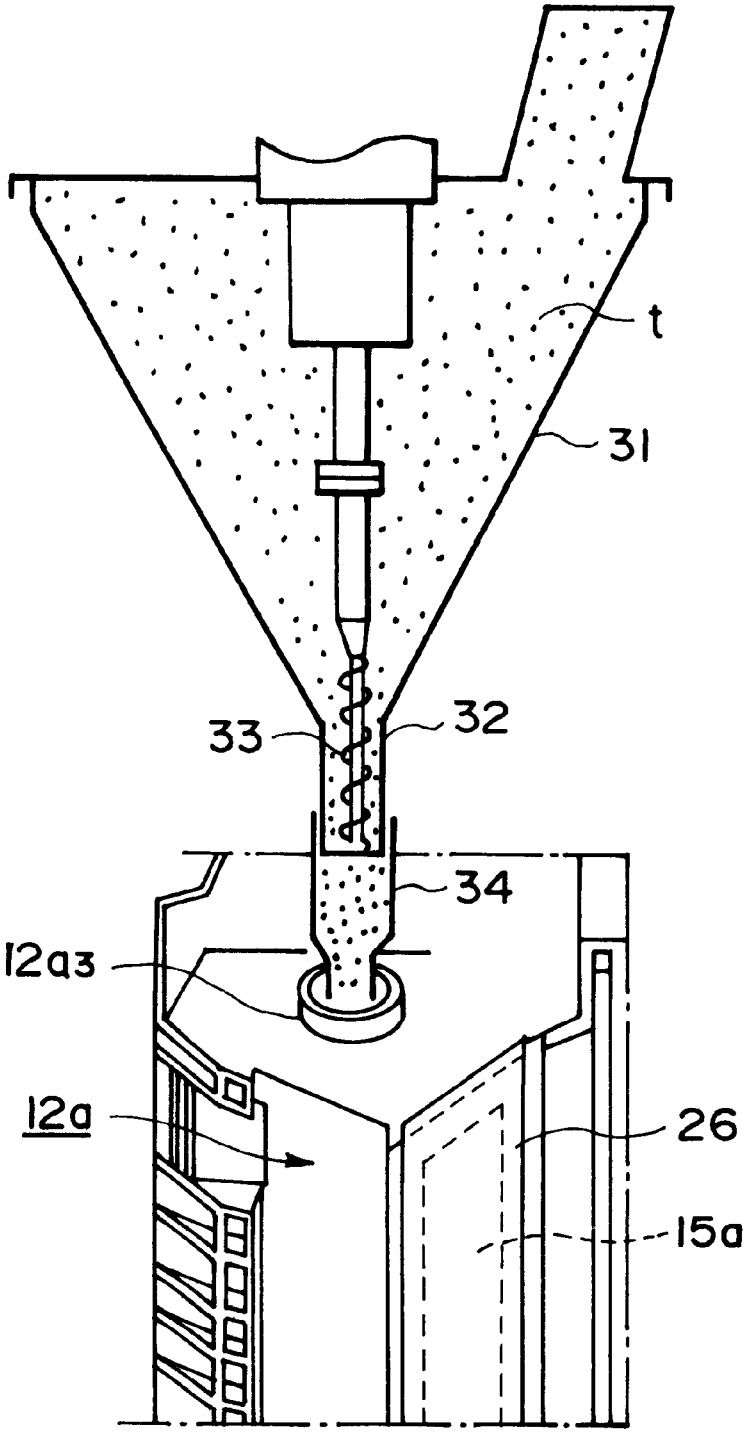
FIG. 17 shows a state in which toner is supplied through a toner inlet port after the sealing of the opening with he re-sealing member.

In the case that the toner is supplied after the opening 15*a* is sealed, a cap 12*a*4 (FIG. 16) covering the toner supply port 12*a*3 in the toner container 12*a* is removed. As shown in FIG. 17, the toner t temporarily accommodated in the toner hopper 31 is discharged by rotation of an auger 33 in an auger casing 32 at a bottom portion of the hopper 31. By controlling the number of screw rotations of the auger 33, the toner discharging speed can be easily controlled. The toner t discharged by the rotation of the auger 33 is supplied into the toner container 12*a* having the opening 15*a* sealed by the sealing member 26, through a toner supply port 12*a*3 through the toner supplying funnel.

After the toner t is supplied to the full of the toner container 12*a*, the toner supply port 12*a*3 is closed by a fresh cap 12*a*4, so that the toner refilling operation is completed.

Figure 18:
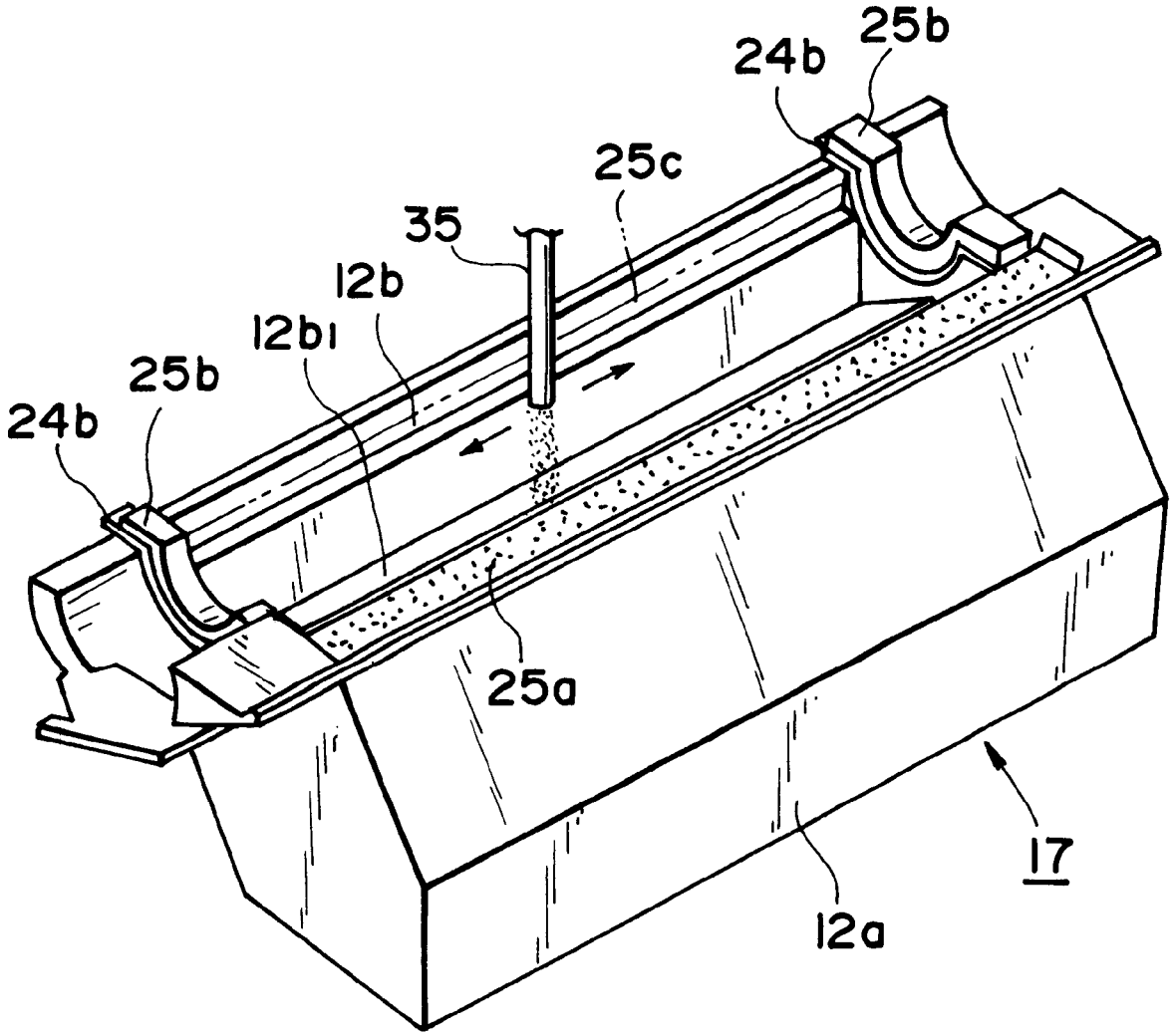
FIG. 18 illustrates a state in which the toner is supplied through the opening before it is sealed by the re-sealing member.

When the toner is filled before the opening 15*a* is sealed, as shown in FIG. 18, the toner container 12*a* before mounting the seal 26, is placed with the opening 15*a* faced up, and a toner supply nozzle 35 connected to a toner supplying machine (not shown) is placed in the opening 15*a*. The toner is discharged through the nozzle 35 to supply the toner into the toner container 12*a*. The nozzle 35 is reciprocated in the longitudinal direction of the opening 15*a* manually by the operator or automatically, thus filling the toner container 12*a* with the toner uniformly.

After the toner filling, the sealing member 26 is inserted into the slit 27 to seal the opening 15*a*.

When the toner is supplied the toner hopper 31 and the funnel 34 described above may be used. When the toner is supplied through the toner support port 12*a*3, the toner supply nozzle 35 may be used.

After the toner is refilled in the manner described above, the developing frame 12*b* or the like are mounted through the steps in reverse to the steps for the disassembling, so that the process cartridge B can be remanufactured. For this remanufacturing, consumption parts mechanically worn, members having deteriorated performance, or parts requiring readjustment, or the like, are preferably exchanged or refreshed to recover the properties or performance thereof. As for the consumption parts, there are seals for preventing toner leakage, and examples of performance deteriorated part include the photosensitive drum. The parts to be reused are inspected by the operator's eyes or by machines, and only the parts satisfying a predetermined level, are used. Upon the start of the reuse of the remanufactured process cartridge, the sealing member 26 is pulled by gripping the grip 26*b*1 of the flexible sheet 26*b*, so that the toner in the toner container 12*a* may be supplied into the developing sleeve 10*c*.

Further Embodiment

In the foregoing embodiment, the use is made with the sliding sheet 28 to improve the insertion operativity when the re-sealing member 26 is inserted into the slit 27. However, the use of the sliding sheet 28 is not inevitable if the material of the elastic sheet 26*a* of the re-sealing member 26 is properly selected, if the surface of the elastic sheet 26*a* is coated with a sliding layer. This is because the sliding property between the elastic sheet 26*a* and the opening limiting member 15 is improved. Therefore, there is no need of overlaying the sliding sheet 28, and the mounting of the re-sealing member 26 is made easier.

In the foregoing embodiment, the flexible sheet 26*b* is integrally mounted to prevent the elastic sheet 26*a* from being torn when the re-sealing member 26 is pulled out. However, the use of the flexible sheet 26*b* is inevitable if the material of the elastic sheet 26*a* is properly selected to use high tensile strength elastic sheet 26*a*. In this case, one end of the elastic sheet 26*a* is extended to be exposed out through the slit 27, to provide the gripping portion for the pulling.

In the foregoing embodiment, the opening limiting member 15 is fused on the edge of the opening of the toner container 12*a*, but the opening limiting member 15 is not inevitable if the size of the opening 12*a*1 of the toner container 12*a* is made equal to the opening 15*a* of the opening limiting member 15.

In the foregoing, the process cartridge B has been described as the cartridges for monochromatic image formation. However, the embodiments are suitably applicable to process cartridges for a multi-color image formation (two color image formation) three-color image formation or full-image formation or the like, by use of a plurality of developing means.

The image bearing member may have, as the photoconductor, zinc oxide, titanium oxide, amorphous silicon, organic photoconductor or the like. It may be in the form of a drum, belt or sheet or the like.

The usable developing methods include known two component magnetic brush development, cascade development, touch-down development, cloud developing method or the like.

As for the charging means, the contact charging is used in the foregoing embodiment. However, another known method is usable in which a tungsten wire is enclosed at three sides with metal shield of aluminum or the like, and a high voltage is applied to the tungsten wire to produce and move positive or negative ions to the surface of the photosensitive drum, thus uniformly charging the surface of the drum.

In addition to a roller type charging member, it may be of blade type (charging blade), pad type, block type, rod type, wire type or the like.

As for the cleaning method for removing the residual toner from the photosensitive drum, a blade, a fur brush, magnetic brush or the like are usable.

The process cartridge described in the foregoing may contain an electrophotographic photosensitive member or the like as the image bearing member, and at least one of process means. For example, the image bearing member and the charging means is unified into a cartridge detachably mountable to a main assembly of the image forming apparatus. The image bearing member and the developing means are unified into a cartridge which detachably mountable to the main assembly. The image bearing member and the cleaning means are unified into a cartridge which is detachably mountable to the main assembly. The image bearing member and to or more of the process means, are unified into a cartridge, which is detachably mountable to the main assembly.

In other words, the process cartridge contains an electrophotographic photosensitive member and at least one of charging means, developing means and cleaning means. The cartridge is detachably mountable relative to the main assembly of the image forming apparatus. As an example, at least the developing means and the electrophotographic photosensitive member are unified into a cartridge.

In the foregoing description, the image forming apparatus is in the form of a laser beam printer, but the present invention is not limited to this. For example, it is applicable to an LED printer, an electrophotographic copying machine, a facsimile machine, word processor or the like.

As described in the foregoing, according to the embodiments of the present invention, the elastic sheet is inserted between the developer container and the developing device frame, by which the elastic sheet is compressed and deformed to be closely contacted to the edge portions of the developer container, and therefore, the opening of the developer container to be reused is sealed by the elastic sheet. By refilling the developer container with the developer, the cartridge can be reused.

For the insertion of the sealing member, the insertion member and the sealing member are not inserted between the developer container and the developing frame while being overlapped with each other, and therefore, the force required for insertion is small, and there is no liability of the damage for the end seals for preventing the toner leakage.

When the sealing member is inserted, it is inserted from one side, and is pulled from the other side, therefore, the insertion member is moved in one way. Therefore, the insertion operativity is improved, and an automatic assembling is possible.

As described in the foregoing, the elastic sheet is compressed and deformed to press-contact to the edge of the opening of the developer container so that the opening of the developer container to be reused is sealed by the elastic sheet. By refilling the developer accommodation container with the developer, the process cartridge can be reused.

While the invention has been described with reference to the structures disclosed herein, it is not confined to the details set forth and this application is intended to cover such modifications or changes as may come within the purposes of the improvements or the scope of the following claims.

What is claimed is:

1. A sealing member for sealing an opening of a toner-accommodating container having a gap which is formed by the toner-accommodating container and a developing frame provided with a developing sleeve, the toner-accommodating container being capable of containing toner for use in developing a latent image formed on an electrophotographic photosensitive member, said sealing member comprising:

a flexible film having a thickness of approximately 10–200 $\mu$m; and an elastic sheet on said flexible film, wherein, to seal the opening, said flexible film and said elastic sheet are inserted into the gap by an insertion member, wherein after the insertion member is removed, the opening remains sealed by saidsealing member remaining in the gap by the elasticity of the elastic sheet, and wherein a surface of said elastic sheet is covered with a sliding sheet when said elastic sheet is inserted into the gap, and, after said elastic sheet is inserted into the gap, the sliding sheet is pulled out of the gap.

2. A sealing member for sealing an opening of a toner-accommodating container having a gap which is formed by the toner-accommodating container and a developing frame provided with a developing sleeve, the toner-accommodating container being capable of containing toner for use in developing a latent image formed on an electrophotographic photosensitive member, said sealing member comprising:

a flexible film made of polyester, drawn polypropylene, nylon, or polyethylene material having a thickness of approximately 10–200 $\mu$m; and an elastic sheet on said flexible film, wherein, to seal the opening, said flexible film and said elastic sheet are inserted into the gap by an insertion member, wherein after the insertion member is removed, the opening remains sealed by said sealing member remaining in the gap by the elasticity of the elastic sheet, and wherein a surface of said elastic sheet is covered with a sliding sheet when said elastic sheet is inserted into the gap, and, after said elastic sheet is inserted into the gap, the sliding sheet is pulled out of the gap.

3. A sealing member for sealing an opening of a toner-accommodating container having a gap which is formed by the toner-accommodating container and a developing frame provided with a developing sleeve, the toner-accommodating container being capable of containing toner for use in developing a latent image formed on an electrophotographic photosensitive member, said sealing member comprising:

a flexible film; and an elastic sheet on said flexible film, said elastic sheet having a length of approximately 220–240 mm, wherein, to seal the opening, said flexible film and said elastic sheet are inserted into the gap by an insertion member, wherein after the insertion member is removed, the opening remains sealed by said sealing member remaining in the gap by the elasticity of the elastic sheet, and wherein a surface of said elastic sheet is covered with a sliding sheet when said elastic sheet is inserted into the gap, and, after said elastic sheet is inserted into the gap, the sliding sheet is pulled out of the gap.

4. A sealing member according to claim 3, wherein said flexible film is of polyester, drawn polypropylene, nylon or polyethylene material.

5. A sealing member according to claim 3, wherein said flexible film has a thickness of approx. 10–200 μm.

6. A sealing member according to claim 1, 2, or 3, wherein said elastic sheet is of a high density foamed polyurethane material having a hardness of 20–70 degrees, a compression permanent deformation of 4% or lower, a friction coefficient of 0.8 or lower, a cell size of 60–300 μm, a specific gravity of 0.2–0.5, and which is compressed by 5–50%.

7. A sealing member according to claim 1, 2 or 3, wherein the sealing member seals the opening by elastic compression deformation of said elastic sheet.

8. A sealing member according to claim 1, 2, or 3, wherein an end of said flexible sheet is temporarily fixed on a metal plate as said insertion member, and on an end of the metal plate opposite from the temporarily fixed end, the sliding sheet is temporarily fixed.

9. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, comprising:

a flexible film; and an elastic sheet on said flexible film, said elastic sheet being made of a high density foamed polyurethane material having a hardness of 20–70 degrees, a compression permanent deformation of 4% or lower, a friction coefficient of 0.8 or lower, a cell size of 60–300 μm, a specific gravity of 0.2–0.5, which is compressed by 5–50%.

10. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, comprising:

a flexible film having a thickness of approximately 10–200 μm; and an elastic sheet on said flexible film, said elastic sheet being made of a high density foamed polyurethane material having a hardness of 20–70 degrees, a compression permanent deformation of 4% or lower, a friction coefficient of 0.8 or lower, a cell size of 60–300 μm, a specific gravity of 0.2–0.5, which is compressed by 5–50%.

11. A sealing member for sealing an opening of a toner-accommodating container having a gap which is formed by the tone-accommodating container and a developing frame provided with a developing sleeve, the toner-accommodating container capable of containing toner for use in developing a latent image formed on an electrophotographic photosensitive member, comprising:

a flexible film made of polyester, drawn polypropylene, nylon, or polyethylene material, having a thickness of approximately 10–200 μm; and an elastic sheet on said flexible film, said elastic sheet being made of a high density foamed polyurethane material having a hardness of 20–70 degrees, a compression permanent deformation of 4% or lower, a friction coefficient of 0.8 or lower, a cell size of 60–300 μm, a specific gravity of 0.2–0.5, which is compressed by 5–50%.

12. A sealing member according to claim 1, 2, 3, 9, 10 or 11, wherein said flexible film has a width of approx. 35–50 mm.

13. A sealing member according to claim 1, 2, 3, 9, 10 or 11, wherein said flexible film has a length of approx. 220–350 mm.

14. A sealing member according to claim 1, 2, 3, 9, 10 or 11, wherein said flexible film has a tensile strength of approx. 2 kgf/15 mm–40 kgf/15 mm under JIS K7113.

15. A sealing member according to claim 1, 2, 3, 9, 10 or 11, wherein said elastic sheet is of foamed polyurethane, foamed polyethylene or silicone rubber.

16. A sealing member according to claim 1, 2, 3, 9, 10 or 11, wherein said elastic sheet has a thickness of approx. 0.5–2 mm.

17. A sealing member according to claim 1, 2, 3, 9, 10 or 11, wherein said elastic sheet has a width of approx. 30–50 mm.

18. A sealing member according to claim 1, 2, 9, 10 or 11, wherein said elastic sheet has a length of approx. 220–240 mm.

19. A sealing member according to claim 1, 2, 3, 9, 10, or 11, wherein said flexible film is so flexible that it is unable to be inserted into a gap by itself.

20. A sealing member according to claim 1, 2, 3, 9, 10 or 11, wherein said elastic sheet is bonded on said flexible sheet by an adhesive material or by a duplicated adhesive tape.

21. A sealing member according to claim 1, 2, 3, 9, 10 or 11, wherein said elastic sheet extends over an entire width of said flexible sheet at an end of said flexible sheet.

22. A sealing member according to claim 9, 10, or 11, wherein an end of said flexible sheet film is temporarily fixed on a metal plate, and on an end of the metal plate opposite from the temporarily fixed end, a sliding sheet is temporarily fixed.

23. A sealing member according to claim 1, 2, 3, 9, 10 or 11, wherein said sealing member is inserted between the toner accommodating container and a developing device frame to seal an opening of the toner accommodation container.

24. A method of sealing an opening of a toner-accommodation container, the toner-accommodation container having a gap and capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, wherein an elastic sheet is mounted to said flexible sheet;

inserting the insertion member between the toner-accommodation container and a frame to a position for sealing the opening by the elastic sheet; and pulling said insertion member out of said gap, thus removing the flexible sheet from the insertion member, wherein said flexible sheet remains between said toner-accommodating container and said frame by an elastic force of said elastic sheet to seal the opening.

25. A method of sealing an opening of a toner-accommodation container, the toner-accommodation container having a gap and capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, the insertion member having a thickness of approximately 0.1–0.5 mm, wherein an elastic sheet is mounted to said flexible sheet;

inserting the insertion member between the toner-accommodation container and a frame to a position for sealing the opening by the elastic sheet; and pulling said insertion member out of said gap, thus removing the flexible sheet from the insertion member, wherein said flexible sheet remains between said toner-accommodating container and said frame by an elastic force of said elastic sheet to seal the opening.

26. A method of sealing an opening of a toner-accommodation container, the toner-accommodation container having a gap and capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, the insertion member being made of stainless steel, steel, or copper, and having a thickness of approximately 0.1–0.5 mm, wherein an elastic sheet is mounted to said flexible sheet;

inserting the insertion member between the toner-accommodation container and a frame to a position for sealing the opening by the elastic sheet; and pulling said insertion member out of said gap, thus removing the flexible sheet from the insertion member, wherein said flexible sheet remains between said toner accommodating container and said frame by an elastic force of said elastic sheet to seal the opening.

27. A method according to claim 24, 25 or 26, further comprising the step of detachably mounting a sliding sheet to another longitudinal end of the insertion member, wherein the sliding sheet is of paper or plastic film coated with silicon wax or Teflon wax.

28. A method of sealing an opening of a toner-accommodation container, the toner-accommodation container having a gap and being capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, wherein an elastic sheet is mounted to said flexible sheet;

inserting the insertion member between the toner-accommodation container and a frame to a position for sealing the opening by the elastic sheet;

pulling said insertion member out of said gap, thus removing the flexible sheet from the insertion member; and detachably mounting a sliding sheet to another longitudinal end of the insertion member, wherein when the insertion member is inserted into the gap, the elastic sheet and the sliding sheet are overlaid.

29. A method of sealing an opening of a toner-accommodation container, the toner-accommodation container having a gap and being capable of containing toner for use in developing a latent image formed on an electrophotographic photosensitive member, the method comprising the steps of:

detachably mounting a flexible sheet to a longitudinal end of an insertion member;

mounting the elastic sheet on a flexible sheet, wherein when the elastic sheet is introduced to a sealing position, a portion of a flexible sheet is projected from a gap between the toner-accommodation container and the frame, and the projected portion may be gripped by a user when the elastic sheet and the flexible sheet are to be pulled out; and detachably mounting a sliding sheet to another longitudinal end of the insertion member, wherein when the insertion member is inserted into the gap, the elastic sheet and the sliding sheet are overlaid;

inserting the insertion member into the gap to a position for sealing the opening by the elastic sheet; and pulling said insertion member out of said gap, thus removing the flexible sheet and sliding sheet from the insertion member.

30. A method of sealing an opening of a toner-accommodation container, the toner-accommodation container having a gap and being capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member;

mounting the elastic sheet on a flexible sheet, wherein when the elastic sheet is introduced to a sealing position, a portion of the flexible sheet is projected from a gap between the toner-accommodation container and the frame, and the projected portion may be gripped by a user when the elastic sheet and the flexible sheet are to be pulled out;

detachably mounting a sliding sheet to another longitudinal end of the insertion member, wherein when the insertion member is inserted into the gap between the toner-accommodation container and the frame, the elastic sheet and the sliding sheet are overlaid;

inserting the insertion member between the toner-accommodation container and a frame to a position for sealing the opening by the elastic sheet; and pulling said insertion member out of said gap, thus removing the flexible sheet from the insertion member.

31. A method of sealing an opening of a toner-accommodation container, the toner-accommodation container having a gap and capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, the insertion member having a thickness of approximately 0.1–0.5 mm;

mounting the elastic sheet on a flexible sheet, wherein when the elastic sheet is introduced to a sealing position, a portion of the flexible sheet is projected from a gap between the toner-accommodation container and the frame, and the projected portion may be gripped by a user when the elastic sheet and the flexible sheet are to be pulled out;

detachably mounting a sliding sheet to another longitudinal end of the insertion member, wherein when the insertion member is inserted into the gap between the toner-accommodation container and the frame, the elastic sheet and the sliding sheet are overlaid;

inserting the insertion member between the toner-accommodation container and a frame to a position for sealing the opening by the elastic sheet; and pulling said insertion member out of said gap thus removing the flexible sheet and sliding sheet from the insertion member.

32. A method of sealing an opening of a toner-accommodation container, the toner-accommodation container having a gap and being capable of containing toner for use in developing a latent image formed on an electrophotographic photosensitive member, the gap being formed by the toner-accommodating container and a developing frame provided with a developing sleeve, the method comprising the steps of:

detachably mounting a flexible sheet to a longitudinal end of an insertion member, the insertion member being made of stainless steel, steel, or copper, and having a thickness of approximately 0.1–0.5 mm;

mounting the elastic sheet on a flexible sheet, wherein when the elastic sheet is introduced to a sealing position, a portion of the flexible sheet is projected from a gap between the toner-accommodation container and the frame, and the projected portion may be gripped by a user when the elastic sheet and the flexible sheet are to be pulled out;

detachably mounting a sliding sheet to another longitudinal end of the insertion member, wherein when the insertion member is inserted into the gap between the toner-accommodation container and the frame, the elastic sheet and the sliding sheet are overlaid;

inserting the insertion member between the toner-accommodation container and a frame to a position for sealing the opening by the flexible sheet; and pulling said insertion member out of said gap, thus removing the flexible sheet from the insertion member.

33. A method according to claim 24, 25, 26, 28, 29, 30, 31, or 32, wherein said insertion member to which the flexible sheet is detachably mounted has a width of approximately 40–45 mm.

34. A method according to claim 24, 25, 26, 28, 29, 30, 31, or 32, wherein the insertion member to which the flexible sheet is detachably mounted has a length of approximately 275–400 mm.

35. A method according to claim 24, 25, 26, 28, 29, 30, 31, or 32, wherein the insertion member to which the flexible sheet is detachably mounted is a plate having a rigidity sufficient for insertion between the toner accommodation container and the frame.

36. A method according to claim 28, 29, 30, 31, or 32, wherein the sliding sheet mounted on the insertion member is of paper or plastic film coated with silicone wax or Teflon wax.

37. A method according to claim 28, 29, 30, 31, or 32, wherein said frame, adjacent which the insertion member is inserted, is provided with a mount for mounting a developing sleeve.

38. A method according to claim 24, 25, 26, 28, 29, 30, 31, or 32, wherein prior to sealing the opening of the toner accommodation container, toner is supplied into the toner accommodation container.

39. A method according to claim 24, 25, 26, 28, 29, 30, 31, or 32, wherein after the opening of the toner accommodation container is sealed, the toner is supplied into the toner accommodation container.

40. A method according to claim 24, 25, 26, 28, 29, 30, 31, or 32, wherein the toner accommodation container is unified with developing means and the electrophotographic photosensitive member to constitute a process cartridge detachably mountable to a main assembly of an image forming apparatus.

41. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film having a thickness of approximately 10–200 $\mu$m; and an elastic sheet on said flexible film, wherein, to seal the opening, said flexible film and said elastic sheet are inserted into the gap by an insertion member, the opening remaining sealed after the insertion member is removed, and wherein an end of said flexible sheet is temporarily fixed on the insertion member, and on an end of the insertion member opposite from the temporarily fixed end, a sliding sheet is temporarily fixed.

42. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film made of polyester, drawn polypropylene, nylon, or polyethylene material having a thickness of approximately 10–200 $\mu$m; and an elastic sheet on said flexible film, wherein, to seal the opening, said flexible film and said elastic sheet are inserted into the gap by an insertion member, the opening remaining sealed after the insertion member is removed, and wherein an end of said flexible sheet is temporarily fixed on the insertion member and on an end of the insertion member opposite from the temporarily fixed end, a sliding sheet is temporarily fixed.

43. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film; and an elastic sheet on said flexible film, said elastic sheet having a length of approximately 220–240 mm, wherein, to seal the opening, said flexible film and said elastic sheet are inserted into the gap by an insertion member, the opening remaining sealed after the insertion member is removed, and wherein an end of said flexible sheet is temporarily fixed on the insertion member, and on an end of the insertion member opposite from the temporarily fixed end, a sliding sheet is temporarily fixed.

44. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film having a thickness of approximately 10–200 $\mu$m; and an elastic sheet on said flexible film, wherein, to seal the opening, said flexible film and said elastic sheet are inserted into the gap by an insertion member, the opening remaining sealed after the insertion member is removed, and wherein said elastic sheet is of a high density foamed polyurethane material having a hardness of 20–70 degrees, a compression permanent deformation of 4% or lower, a friction coefficient of 0.8 or lower, a cell size of 60–300 $\mu$m, a specific gravity of 0.2–0.5, and which is compressed by 5–50%.

45. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film made of polyester, drawn polypropylene, nylon, or polyethylene material having a thickness of approximately 10–200 $\mu$m; and an elastic sheet on said flexible film, wherein, to seal the opening, said flexible film and said elastic sheet are inserted into the gap by an insertion member, the opening remaining sealed after the insertion member is removed, and wherein said elastic sheet is of a high density foamed polyurethane material having a hardness of 20–70 degrees, a compression permanent deformation of 4% or lower, a friction coefficient of 0.8 or lower, a cell size of 60–300 $\mu$m, a specific gravity of 0.2–0.5, and which is compressed by 5–50%.

46. A sealing member for sealing an opening of a toner-accommodating container having a gap which is formed by the toner-accommodating container and a developing frame provided with a developing sleeve, the toner-accommodating container capable of containing toner for use in developing a latent image formed on an electrophotographic photosensitive member, said sealing member comprising:

a flexible film; and an elastic sheet on said flexible film, said elastic sheet having a length of approximately 220–240 mm, wherein, to seal the opening, said flexible film and said elastic sheet are inserted into the gap by an insertion member, the opening remaining sealed after the insertion member is removed, and wherein said elastic sheet is of a high density foamed polyurethane material having a hardness of 20–70 degrees, a compression permanent deformation of 4% or lower, a friction coefficient of 0.8 or lower, a cell size of 60–300 $\mu$m, a specific gravity of 0.2–0.5, and which is compressed by 5–50%.

* * * * *

UNITED STATES PATENT AND TRADEMARK OFFICE

CERTIFICATE OF CORRECTION

PATENT NO. : 6,118,958
DATED : September 12, 2000
INVENTOR(S) : Toshiaki Nagashima, et al.

It is certified that error appears in the above-identified patent and that said Letters Patent is hereby corrected as shown below:

Title page,

Item [56] References Cited,
"4086772 3/1992 Japan." should read -- 4-086772 3/1992 Japan. --.

Column 2,
Line 47, "he" should read -- the --.

Column 3,
Lines 33-36, " Image Forming Apparatus The description will be made as to an optical system, feeding means, transfer means, fixing means and cartridge mounting means in this order." should read
-- Image Forming Apparatus
The description will be made as to an optical system, feeding means, transfer means, fixing means and cartridge mounting means in this order. --.

Column 9,
Line 54, "12b" should read -- 12a --.
Line 65, "part" should read -- parts --.

Column 11,
Line 29, "going" should read -- doing --.

UNITED STATES PATENT AND TRADEMARK OFFICE

CERTIFICATE OF CORRECTION

PATENT NO. : 6,118,958
DATED : September 12, 2000
INVENTOR(S) : Toshiaki Nagashima, et al.

It is certified that error appears in the above-identified patent and that said Letters Patent is hereby corrected as shown below:

Column 13,
Line 55, "to" should read -- two --.

Column 14,
Line 50, "saidsealing" should read -- said sealing --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*